US011425998B2

(12) United States Patent
Sisto

(10) Patent No.: US 11,425,998 B2
(45) Date of Patent: Aug. 30, 2022

(54) SHELF SYSTEM AND METHOD OF MOUNTING A SHELF

(71) Applicant: Salvatore Sisto, East Brunswick, NJ (US)

(72) Inventor: Salvatore Sisto, East Brunswick, NJ (US)

(73) Assignee: SALTO, LLC

( * ) Notice: Subject to any disclaimer, the term of this patent is extended or adjusted under 35 U.S.C. 154(b) by 41 days.

(21) Appl. No.: 16/993,471

(22) Filed: Aug. 14, 2020

(65) Prior Publication Data

US 2021/0045531 A1 Feb. 18, 2021

Related U.S. Application Data

(60) Provisional application No. 62/888,094, filed on Aug. 16, 2019.

(51) Int. Cl.
*A47B 96/02* (2006.01)
*A47B 96/06* (2006.01)

(52) U.S. Cl.
CPC ..... *A47B 96/027* (2013.01); *A47B 96/061* (2013.01); *A47B 96/066* (2013.01); *A47B 96/068* (2013.01)

(58) Field of Classification Search
CPC ..... A47B 96/027; A47B 96/028; A47B 96/06; A47B 96/061; A47B 96/066; A47B 96/068; A47K 2201/00; A47K 2201/02
USPC ..... 248/239, 250
See application file for complete search history.

(56) References Cited

U.S. PATENT DOCUMENTS 2,239,798 A * 4/1941 Tinnerman ..... F24C 15/024 16/422
3,527,175 A * 9/1970 Kapnek ..... A47B 5/02 108/152
3,704,675 A 12/1972 Bellasalma
3,752,088 A 8/1973 Kapnek
4,381,715 A * 5/1983 Forman ..... A47B 96/066 108/102
4,422,616 A 12/1983 Wilke et al.
(Continued)

FOREIGN PATENT DOCUMENTS

DE 102011112029 3/2013
EP 0750464 6/1998
(Continued)

*Primary Examiner* — Jonathan Liu
*Assistant Examiner* — Guang H Guan
(74) *Attorney, Agent, or Firm* — Belles Katz LLC

(57) ABSTRACT

A shelf system for mounting a shelf to a wall, which includes a shelf having a rear edge and first and second shelf fasteners coupled to the shelf and protruding from the rear edge. The shelf system may also include a mounting bracket assembly for mounting directly to a wall and to which the shelf is to be coupled. The mounting bracket assembly may include first and second shelf engaging portions that have mounting apertures therethrough. Wall fasteners may extend through the mounting apertures of the first and second shelf engaging portions to mount the mounting bracket assembly to the wall. The portions of the first and second shelf fasteners which protrude from the rear edge of the shelf may be inserted into the mounting apertures of the first and second shelf engaging portions of the mounting bracket assembly to couple the shelf to the mounting bracket assembly.

18 Claims, 14 Drawing Sheets

(56) References Cited

U.S. PATENT DOCUMENTS

| | | | | |
|---|---|---|---|---|
| 4,898,355 | A * | 2/1990 | Steinway | A47B 96/062 211/90.01 |
| 5,197,703 | A | 3/1993 | Pratolongo | |
| 5,954,306 | A * | 9/1999 | Hoover | A47B 96/066 248/250 |
| 6,007,285 | A | 12/1999 | Sisto et al. | |
| 6,012,692 | A * | 1/2000 | Meek | A47K 10/10 248/222.14 |
| 6,591,762 | B1 * | 7/2003 | Haghayegh | A47B 96/022 108/42 |
| 7,055,788 | B2 * | 6/2006 | Migli | A47B 96/065 248/239 |
| 8,070,148 | B2 * | 12/2011 | Nishida | A47J 47/005 269/302.1 |
| 8,082,859 | B2 | 12/2011 | Sevack | |
| 8,695,253 | B2 * | 4/2014 | Bednarksi | G09F 7/20 40/607.13 |
| 8,950,600 | B2 | 2/2015 | Sisto | |
| 9,163,415 | B2 * | 10/2015 | Nies | A47B 96/027 |
| 9,453,524 | B2 | 9/2016 | Sisto | |
| 9,861,198 | B2 | 1/2018 | Anderson | |
| 10,463,151 | B2 | 11/2019 | Murphy | |
| 10,575,641 | B1 | 3/2020 | Severa | |
| 10,588,412 | B2 | 3/2020 | Graber et al. | |
| 2009/0224119 | A1 | 9/2009 | Heffernan | |
| 2018/0168348 | A1 | 6/2018 | Carnelos et al. | |
| 2021/0045531 | A1 * | 2/2021 | Sisto | A47B 96/027 |

FOREIGN PATENT DOCUMENTS

| | | |
|---|---|---|
| EP | 1793129 | 6/2007 |
| GB | 2293963 | 4/1996 |
| JP | 2005348954 | 12/2005 |
| JP | 2011092626 | 5/2011 |
| WO | WO2017001422 | 1/2017 |

* cited by examiner

SHELF SYSTEM AND METHOD OF MOUNTING A SHELF

CROSS-REFERENCE TO RELATED APPLICATIONS

The present application claims priority to U.S. Provisional Patent Application Ser. No. 62/888,094, filed Aug. 16, 2019, the entirety of which is incorporated herein by reference.

FIELD OF THE INVENTION

The present invention relates generally to a shelf system which allows for simple mounting to a wall while also being robust and having enhanced structural stability.

BACKGROUND OF THE INVENTION

Hanging furniture always comes with the toll of damaging the wall or support structure which the furniture is secured to. Each additional shelf or hook that is added to the wall or that is repositioned requires the addition of a new hole and thus further damages the existing wall. Moreover, mounting a shelf or hook directly against the surface of the wall leads to additional scuffs and scratches. Moreover, for most people much effort goes into hanging a shelf securely and straight. As such, there is a need for a system that facilitates a quick install of a shelf on a wall, that minimizes the damage to the surface of the wall, and that provides sufficient structural integrity such that the shelf can support common household objects.

SUMMARY OF THE INVENTION

The invention may be directed to a shelf system for mounting a shelf to a wall, which includes a shelf having a rear edge and first and second shelf fasteners coupled to the shelf and protruding from the rear edge. The shelf system may also include a mounting bracket assembly for mounting directly to a wall and to which the shelf is to be coupled. The mounting bracket assembly may include first and second shelf engaging portions that have mounting apertures therethrough. Wall fasteners may extend through the mounting apertures of the first and second shelf engaging portions to mount the mounting bracket assembly to the wall. The portions of the first and second shelf fasteners which protrude from the rear edge of the shelf may be inserted into the mounting apertures of the first and second shelf engaging portions of the mounting bracket assembly to couple the shelf to the mounting bracket assembly.

In one aspect, the invention may be a shelf system for mounting a shelf to a wall, the shelf system comprising: a shelf comprising a rear edge; a first shelf fastener and a second shelf fastener coupled to the shelf, a first portion of each of the first and second shelf fasteners protruding from the rear edge of the shelf; a mounting bracket assembly configured to be mounted to a wall, the mounting bracket assembly comprising: a first shelf engaging portion configured to extend from the wall to a distal end and comprising an inner surface that defines a cavity that extends along a cavity axis that is perpendicular to the wall when the mounting bracket assembly is mounted to the wall; and a second shelf engaging portion configured to extend from the wall to a distal end and comprising an inner surface that defines a cavity that extends along a cavity axis that is perpendicular to the wall when the mounting bracket assembly is mounted to the wall; and wherein the first portions of the first and second shelf fasteners are positioned within the cavities of the first and second shelf engaging portions of the mounting bracket assembly, respectively, to couple the shelf to the mounting bracket assembly, at least a portion of the rear edge of the shelf which is adjacent to the distal ends of the first and second shelf engaging portions of the mounting bracket assembly being spaced apart from the wall.

In another aspect, the invention may be a shelf system for mounting a shelf to a wall, the shelf system comprising: a shelf having a front edge, a rear edge, and a support surface extending from the front edge to the rear edge; a first shelf fastener comprising a first portion and a second portion, the second portion being embedded within the shelf and the first portion protruding from the rear edge of the shelf; a second shelf fastener comprising a first portion and a second portion, the second portion being embedded within the shelf and the first portion protruding from the rear edge of the shelf; a first mounting bracket comprising a rear surface configured to abut an outer surface of a wall and a distal end, a first opening in the distal end, a second opening in the rear surface, and a first mounting aperture extending through the first mounting bracket along a first cavity axis from the first opening to the second opening, the first mounting aperture comprising a first portion located adjacent to the distal end and having a first transverse cross-sectional area and a second portion located adjacent to the rear surface and comprising a second transverse cross-sectional area that is less than the first transverse cross-sectional area; a second mounting bracket comprising a rear surface configured to abut the outer surface of the wall and a distal end, a first opening in the distal end, a second opening in the rear surface, and a second mounting aperture extending through the second mounting bracket along a second cavity axis from the first opening to the second opening, the second mounting aperture comprising a first portion located adjacent to the distal end and having a first transverse cross-sectional area and a second portion located adjacent to the rear surface and comprising a second transverse cross-sectional area that is less than the first transverse cross-sectional area; a first wall fastener inserted through the first opening in the distal end of the first mounting bracket to mount the first mounting bracket to the wall, a first portion of the first wall fastener located in the first portion of the first mounting aperture of the first mounting bracket, a second portion of the first wall fastener located in the second portion of the first mounting aperture of the first mounting bracket, and a third portion of the first wall fastener protruding from the rear surface of the first mounting bracket and configured for insertion into the wall; a second wall fastener inserted through the first opening in the distal end of the second mounting bracket to mount the second mounting bracket to the wall, a first portion of the second wall fastener located in the first portion of the second mounting aperture of the second mounting bracket, a second portion of the second wall fastener located in the second portion of the second mounting aperture of the second mounting bracket, and a third portion of the second wall fastener protruding from the rear surface of the second mounting bracket and configured for insertion into the wall; and wherein the shelf is mounted to the first and second mounting brackets by inserting the first portion of the first shelf fastener into the first mounting aperture of the first mounting bracket through the first opening in the distal end of the first mounting bracket and inserting the first portion of the second shelf fastener into the second mounting aperture of the second mounting bracket through the first opening in the distal end of the second mounting bracket.

In yet another aspect, the invention may be a method of mounting a shelf to a wall, the method comprising: positioning a rear surface of a mounting bracket assembly against an outer surface of a wall, first and second shelf engaging portions of the mounting bracket assembly protruding from the outer surface of the wall; inserting a first wall fastener through a first opening in a distal end of the first shelf engaging portion until a portion of the first wall fastener extends through a second opening in the rear surface of the mounting bracket assembly and into the wall; inserting a second wall fastener through a first opening in a distal end of the second shelf engaging portion until a portion of the second wall fastener extends through a third opening in the rear surface of the mounting bracket assembly and into the wall; aligning a first shelf fastener protruding from a rear edge of the shelf with the first opening in the distal end of the first shelf engaging portion of the mounting bracket assembly and aligning a second shelf fastener protruding from the rear edge of the shelf with the first opening in the distal end of the second shelf engaging portion of the mounting bracket assembly; and moving the shelf towards the wall so that: the first shelf fastener extends through the first opening in the distal end of the first shelf engaging portion of the mounting bracket assembly and nests within a first cavity of the first shelf engaging portion of the mounting bracket assembly; and the second shelf fastener extends through the first opening in the distal end of the second shelf engaging portion of the mounting bracket assembly and nests within a second cavity of the second shelf engaging portion of the mounting bracket assembly.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
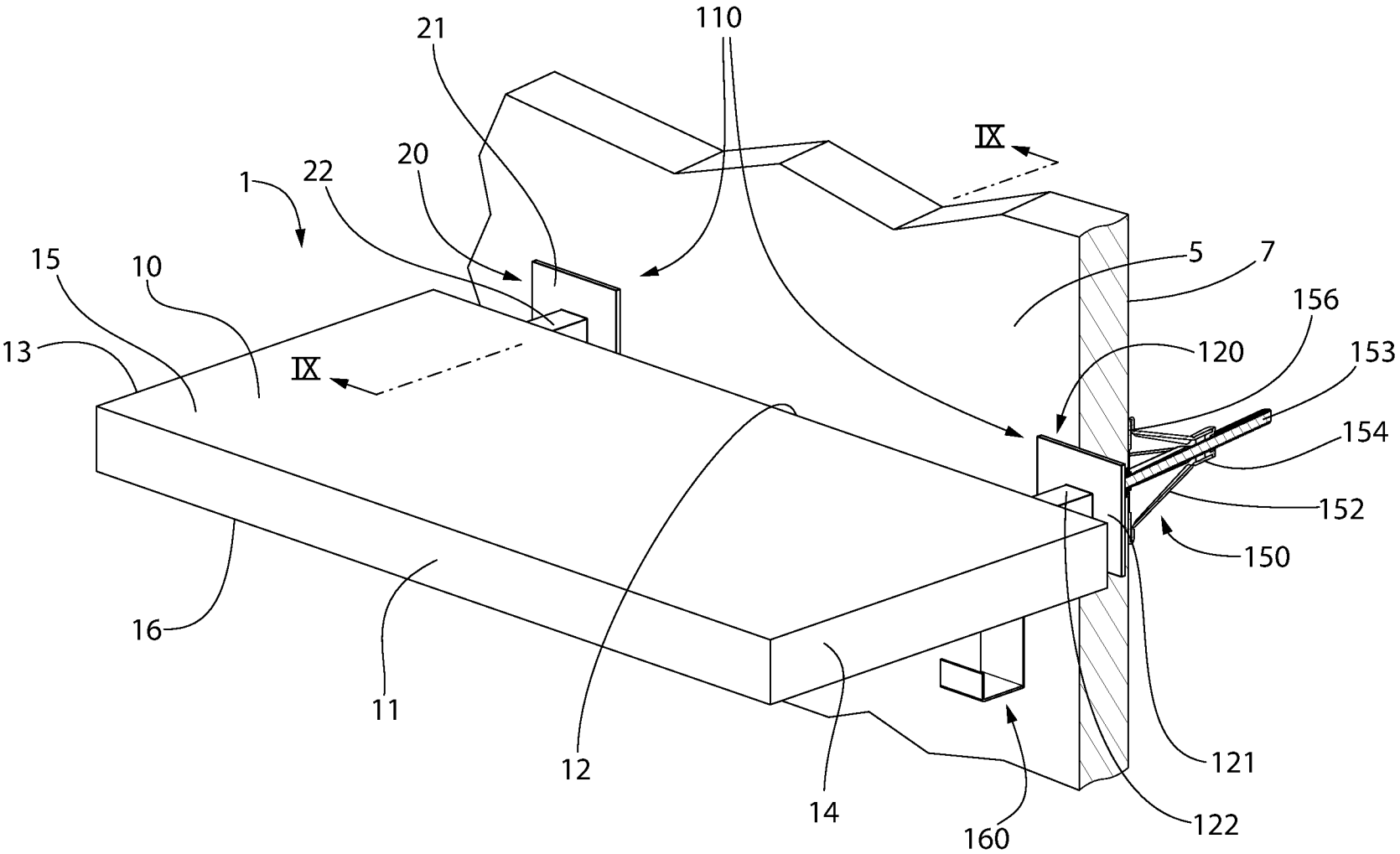
FIG. 1 is a perspective view of a shelf system mounted to a support structure in accordance with a first embodiment of the present invention.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION OF THE INVENTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
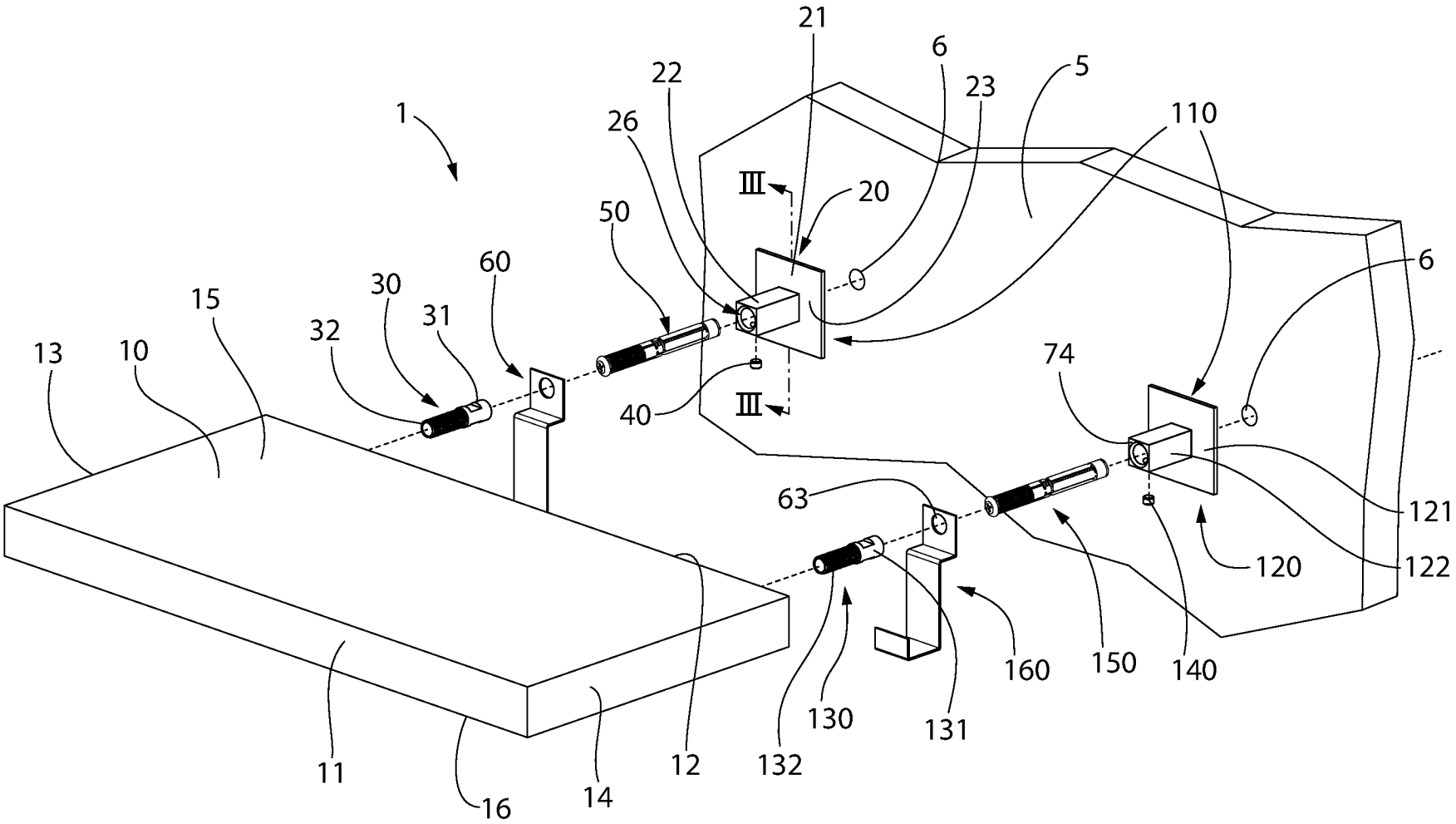
FIG. 2 is an exploded perspective view of the shelf system of FIG. 1.

Referring first to FIGS. 1 and 2, a shelf system 1 is illustrated in accordance with an embodiment of the present invention. In FIG. 1, the shelf system 1 is fully assembled and mounted to a support structure 5, whereas FIG. 2 illustrates the shelf system 1 with the component parts exploded and separated to illustrate each of the components that make up the shelf system 1. The shelf system 1 provides an aesthetically pleasing and efficient apparatus for mounting a shelf to a support structure, ensuring ease of installation and robust structural integrity. In the exemplified embodiment, the support structure 5 is a wall as that is the most typical location for installation or mounting of a shelf. However, the invention is not to be so limited in all embodiments and the support structure 5 may be structures other than a wall in other embodiments, such as an outer wall of a cabinet, dresser, or other piece of furniture, an exterior wall rather than an interior wall such as drywall, or the like. Furthermore, the support structure 5 may be a wall formed from any material, such as a brick wall, a wall formed from drywall or plasterboard, a wood wall, etc.

The shelf system 1 generally comprises a mounting bracket assembly 110 comprising a first mounting bracket 20 and a second mounting bracket 120, a first wall fastener 50 and a second wall fastener 150 that are used to mount the mounting bracket assembly 110 to the support surface 5, a shelf 10, a first shelf fastener 30 and a second shelf fastener 130 which are coupled to the shelf 10 and used to attach the shelf 10 to the mounting bracket assembly 110, and a first hook member 60 and a second hook member 160. The first and second hook members 60, 160 may be considered accessories and they may not be included in all embodiments of the shelf system 1. Thus, the first and second hook members 60, 160 may serve as optional components because they do not facilitate the mounting of the shelf 10 to the support surface 50 and could readily be omitted without affecting the structural integrity of the shelf system 1 or the ability to mount the shelf system 10 to the support structure 5. The first and second hook members 60, 160 are merely additional components that provide an additional benefit to a user as a place to hang items such as coats, umbrellas, hats, keys, or the like.

The mounting bracket assembly 110 is the component or components that are mounted directly to the support structure 5 and to which the shelf 10 is coupled to hang the shelf from the support structure 5. Thus, the shelf 10 is not attached directly to the support structure 5, but rather the shelf 10 is attached to the mounting bracket assembly 110, and the mounting bracket assembly 110 is attached to the support structure 5.

In the exemplified embodiment, the mounting bracket assembly 110 comprises the first mounting bracket 20 and the second mounting bracket 120. The first mounting bracket 20 comprises a wall engaging portion 21 and a first shelf engaging portion 22 and the second mounting bracket 120 comprises a second wall engaging portion 121 and a second shelf engaging portion 122. The first and second wall engaging portions 21, 121 are the portions of the first and second mounting brackets 20, 120 that are in contact with or abutted against the support structure 5 when mounted to the support structure 5. The first and second shelf engaging portions 22, 122 are the portions of the first and second mounting brackets 20, 120 which facilitate the attachment of the shelf 10 to the first and second mounting brackets 20, 120. Although two of the shelf engaging portions 22, 122 are shown in the exemplified embodiment, more than two shelf engaging portions 22, 122 could be used to accommodate a shelf having a longer width. Furthermore, it may be possible to attach the shelf 10 using a mounting bracket assembly having a single shelf engaging portion in other embodiments.

Although in the exemplified embodiment the mounting bracket assembly 110 comprises the first and second mounting brackets 20, 120 which are separate and distinct components, the invention is not to be so limited in all embodiments. Specifically, in other embodiments the mounting bracket assembly may be a singular component such that the singular mounting bracket assembly includes the first and second shelf engaging portions as a part of a unitary structure. Thus, for example, the mounting bracket assembly 110 may include a singular wall engaging portion and the first and second shelf engaging portions 22, 122 may extend from that singular wall engaging portion, albeit in a spaced apart manner. In other words, the first and second wall engaging portions 21, 121 as shown in FIGS. 1 and 2 could be connected to form a singular component. Thus, whether the mounting bracket assembly 110 comprises a singular component, two components, or more than two components is not to be limiting of the invention in all embodiments. Moreover, in some embodiments the wall engaging portions 21, 121 may be omitted and the mounting bracket assembly 110 may comprise only the shelf engaging portions 22, 122, which may be abutted against the support structure 5 and also serve as the connection point for the shelf 10. The mounting bracket assembly 110, and specifically the first and second mounting brackets 20, 120 thereof, may be formed from metal such as stainless steel in some embodiments, although other materials may be used in other embodiments such as plastic, wood, or the like.

Returning to the exemplified embodiment, the shelf system 1 includes the first and second mounting brackets 20, 120 for securing the shelf 10 to the support structure 5. Each of the first and second mounting brackets 20, 120 includes the wall engaging portion 21, 121 and the shelf engaging portion 22, 122. In the exemplified embodiment, the wall engaging portions 21, 121 are flat plate-like structures, but it need not be limited as such in all embodiments. The wall engaging portions 21, 121 have a square shape and act as the base for the first and second mounting brackets 20, 120. Although the wall engaging portions 21, 121 are square in shape in the exemplified embodiment, they may be rectangular, triangular, circular, or any other shape in other embodiments. The wall engaging portions 21, 121 have a front surface 23, 123 and a rear surface 24, 124 opposite the front surface 23, 123, and a thickness measured between the front and rear surfaces 23, 123, 24, 124. The rear surfaces 24, 124 of the wall engaging portions 21, 121 of the mounting brackets 20, 120 are in contact with the support structure 5 when the shelf apparatus 1 is mounted thereto.

As mentioned above, the first and second mounting brackets 20, 120 acts as the intermediary between the shelf 10 and the support structure 5. As such, the first and second mounting brackets 20, 120 provide an offset space for the shelf 10 such that a rear edge 12 of the shelf 10 does not come in surface contact with an exposed outer surface 8 of the support structure 5. This offset space is directly proportional to the length of the first and second mounting brackets 20, 120 measured from the rear surface 24, 124 of the wall engaging portions 21, 121 to a distal end 25, 125 of the shelf engaging portions 22, 122. The greater the length of the first and second mounting brackets 20, 120, the greater the offset space between the shelf 10 and the support structure 5. Similarly, the smaller the length of the first and second mounting brackets 20, 120, the smaller the offset space between the shelf 10 and the support structure 5. An offset space provides the added benefit of being able to store larger items on a shelf apparatus 1 without the item extending past a front edge 11 of the shelf 10 which is opposite the support structure 5. Additionally, the offset space helps to prevent larger household items that are placed on the shelf apparatus 1 from coming in-contact-with and damaging the support structure 5. Therefore, the offset space helps to minimize or prevent larger household items from falling off of the shelf 10 while also minimizing or preventing the further damaging or scuffing of the support structure 5.

Figure 3:
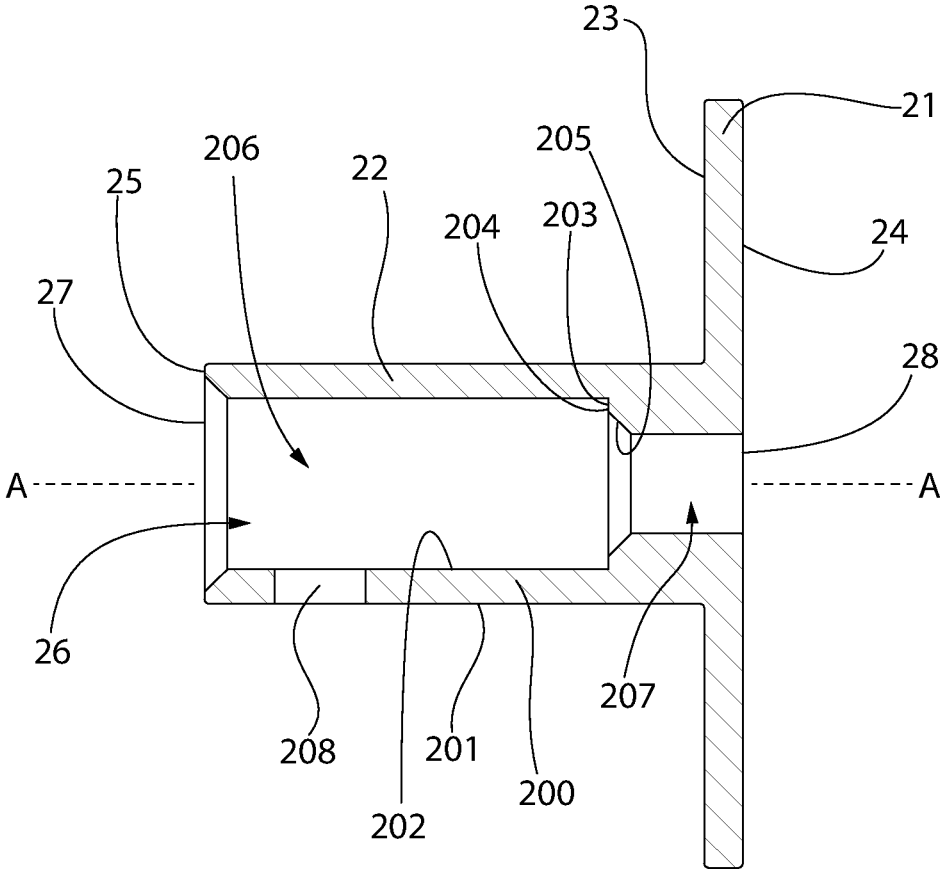
FIG. 3 is a cross-sectional view taken along line III-III of FIG. 2.

Referring to FIGS. 2 and 3, the first mounting bracket 20 of the mounting bracket assembly 110 will be described in greater detail. In the exemplified embodiment, the second mounting bracket 120 is an exact replica of the first mounting bracket 20 such that the first and second mounting brackets 20, 120 are structurally identical. Thus, features of the second mounting bracket 120 will be numbered in the same manner as features of the first mounting bracket 20, except that the numbering used will start with a "1," and this will be done even where that specific structure is not being called out with reference to the second mounting bracket 120.

As noted above, the first mounting bracket 20 comprises the wall engaging portion 21 and the shelf engaging portion 22. The wall engaging portion 21 could be omitted in some embodiments and the first mounting bracket 20 could include just the shelf engaging portion 22. In the exemplified embodiment, the wall engaging portion 21 comprises the front surface 23 and the rear surface 24, with the rear surface 24 of the wall engaging portion 21 forming the rear surface of the first mounting bracket 20. When mounted to the support surface (i.e., the wall) 5, the rear surface 24 of the wall engaging portion 21 of the first mounting bracket 20 (or at least a portion thereof) is in direct contact with the support surface 5. The wall engaging portion 21 has a square shape in the exemplified embodiment, but this is not to be limiting of the invention in all embodiments and the wall engaging portion 21 could take on other shapes including circular, rectangular, other polygonal shapes, irregular shapes, or the like.

The shelf engaging portion 22 of the first mounting bracket 20 protrudes from the front surface 23 of the wall engaging portion 21 and terminates at the distal end 25. Thus, when the mounting bracket assembly 110 is mounted to the support surface 5, the shelf engaging portion 22 extends from the support surface 5 to the distal end 25, which is spaced a distance from the support surface 5. In the exemplified embodiment, the shelf engaging portion 22 is in the shape of a square prism. However, the invention is not to be so limited in all embodiments and the shelf engaging portion 22 may be in the shape of a cylinder in other embodiments, or the shelf engaging portion 22 may be a prism having different polygonal base shapes. The shape of the shelf engaging portion 22 may be determined based on a desired aesthetic and are not to be limiting of the present invention in all embodiments. The shelf engaging portion 22 is tubular in shape (without limitation to the transverse cross-sectional shape of the tube) because it has a hollow interior, as described in greater detail below.

The first mounting bracket 20 is a unitary and integral structure, such that the shelf engaging portion 22 and the wall engaging portion 21 are integrally coupled together as a single, unitary part. In other embodiments, the shelf engaging portion 22 could be manufactured separately from the wall engaging portion 21 and coupled thereto using fasteners, adhesive, welding, or the like.

The first mounting bracket 20 comprises a first mounting aperture 26 which facilitates both the mounting of the first mounting bracket 20 to the support structure 5 and the coupling or mounting of the shelf 10 to the first mounting bracket 20. The first mounting aperture 26 extends from a first opening 27 formed into the distal end 25 of the shelf mounting portion 22 to a second opening 28 formed into the rear surface 24 of the wall mounting portion 21. In embodiments that omit the wall mounting portion 21, the first mounting aperture 26 may simply extend entirely through the shelf mounting portion 22. The first mounting aperture 26 extends from the rear surface 24 of the wall mounting portion 21 to the distal end 25 of the shelf mounting portion 22 along a cavity axis A-A. Thus, the first mounting aperture 26 extends entirely through the first mounting bracket 20 along the full length of the first mounting bracket 20 so that fasteners can be inserted into the first mounting aperture 26 through one end of the first mounting bracket 20 and then extend out through the other end for purposes of mounting the first mounting bracket 20 to the support structure 5, as described in more detail below.

The shelf mounting portion 22 of the first mounting bracket 20 comprises a sidewall 200 that extends from the wall mounting portion 21 to the distal end 25. The sidewall 200 comprises an outer surface 201 and an inner surface 202, with the inner surface 201 defining and surrounding the first mounting aperture 26 (or at least a portion thereof which extends through the shelf mounting portion 22). The inner surface 202 of the sidewall 200 of the shelf mounting portion 22 of the first mounting bracket 20 comprises a shoulder 203. In the exemplified embodiment, the shoulder 203 comprises a ledge portion 204 that extends in a direction that is perpendicular to the cavity axis A-A and a tapering portion 205 that extends in a direction that is oblique to the cavity axis A-A and oblique to the ledge portion 204. The tapering portion 205 is located between the ledge portion 204 and the rear surface 24 of the first mounting bracket 20. In some embodiments, the tapering portion 205 may be omitted and the shoulder 203 may include only the ledge portion 204.

Thus, the shoulder 203 separates the first mounting aperture 26 into a first portion 206 which extends from the distal end 25 to the shoulder 203 and a second portion 207 which extends from the rear surface 24 to the shoulder 204. The first portion 206 of the first mounting aperture 26 forms a cavity of the first mounting aperture 26 within which the shelf fasteners 30, 130 are disposed when the shelf 10 is coupled to the first and second mounting brackets 20, 120. The first portion 206 of the first mounting aperture 26 has a first transverse cross-sectional area. The second portion 207 of the first mounting aperture 26 has a second transverse cross-sectional area, which is smaller than the first transverse cross-sectional area.

The shelf mounting portion 22 of the first mounting bracket 20 also comprises a first locking aperture 208 which extends from the outer surface 201 of the sidewall 200 to the inner surface 202 of the sidewall 200. Thus, the first locking aperture 208 forms another passageway into the first mounting aperture 26 which is distinct from the first opening 27 in the distal end 25 of the shelf mounting portion 22 and from the second opening 28 in the rear surface 24 of the wall mounting portion 21. The first locking aperture 208 extends from the outer surface 201 to the inner surface 202 in a direction that is perpendicular to the cavity axis A-A. The first locking aperture 208 is configured to receive a first set screw 40 (shown in FIG. 2). Furthermore, the shelf mounting portion 122 of the second mounting bracket 120 comprises a second locking aperture (not shown, but identical to the first locking aperture 208 since the second mounting bracket 120 is identical to the first locking bracket 20). The second locking aperture of the shelf mounting portion 122 of the second mounting bracket 120 is configured to receive a second set screw 140 (see FIG. 2). It is being reiterated here that in the exemplified embodiment, the second mounting bracket 120 is identical to the first mounting bracket 20 and thus all features, structures, shapes, and materials described herein with reference to the first mounting bracket 20 are applicable to the second mounting bracket 120.

Figure 4:
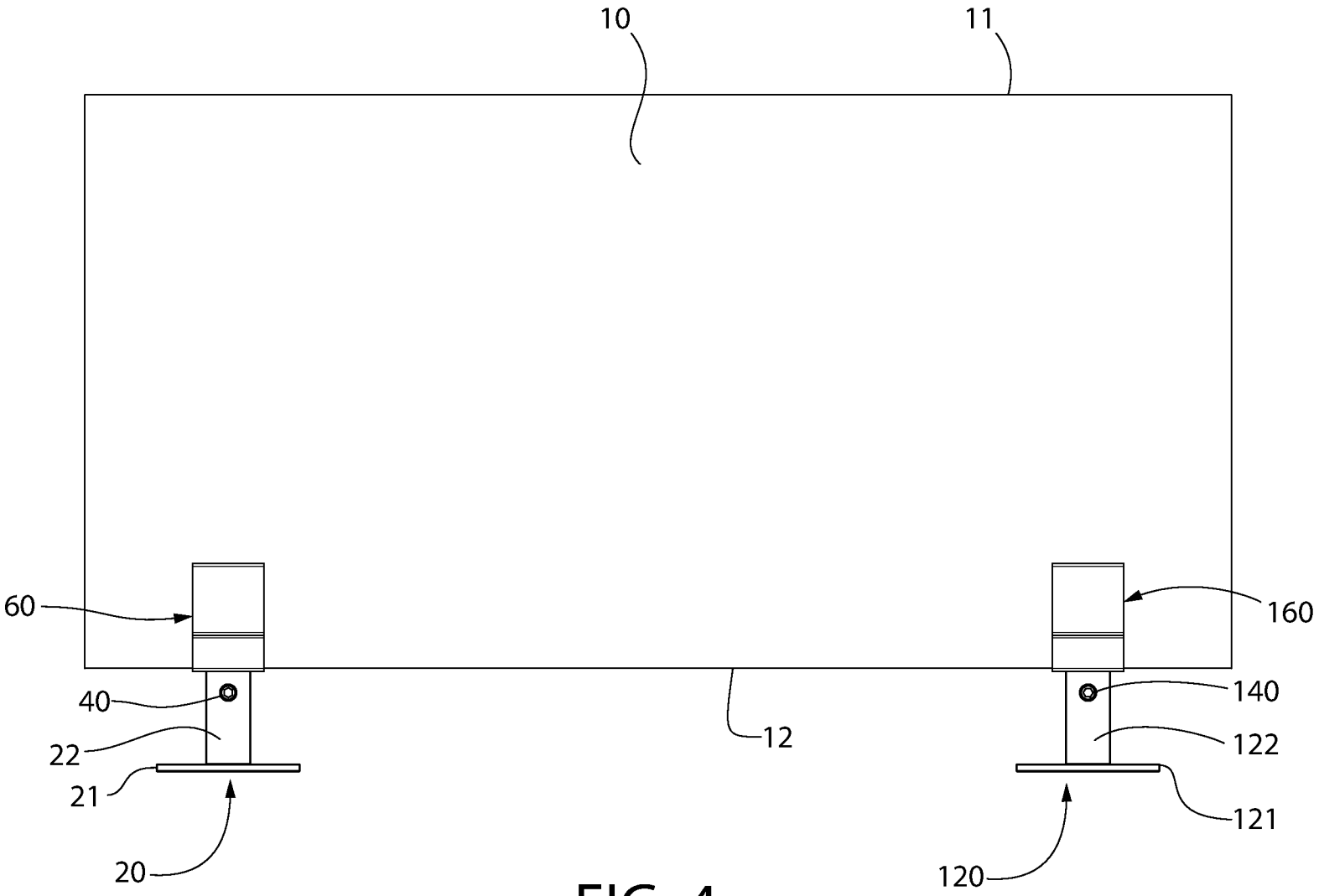
FIG. 4 is a bottom view of the shelf system of FIG. 1.

Referring briefly to FIG. 4, a bottom view of the shelf system 1 is provided with the shelf system 1 in an assembled state. FIG. 4 provides a view of the first and second set screws 40, 140 coupled to the first and second shelf engaging portions 22, 122 of the first and second mounting brackets 20, 120. The first and second set screws 40, 140 can be tightened to lock the shelf 10 to the mounting bracket assembly 110 and loosened to unlock the shelf 10 from the mounting bracket assembly 110 to allow for disassembly of the shelf system 10. The hook members 60, 160 are also shown in FIG. 4, although these may be omitted in other embodiments as mentioned above.

Figure 5A:
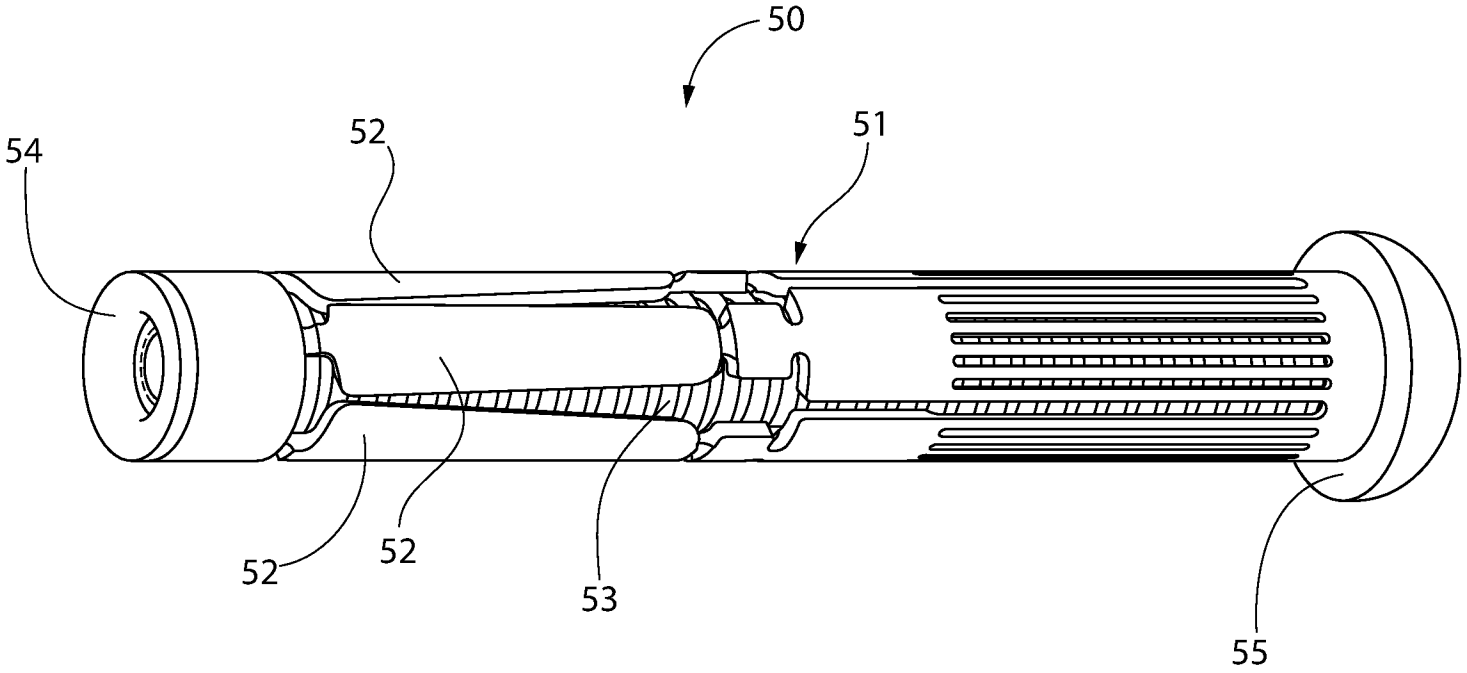
FIG. 5A is a perspective view of a wall fastener of the shelf system of FIG. 1 in an unexpanded state.
Figure 5B:
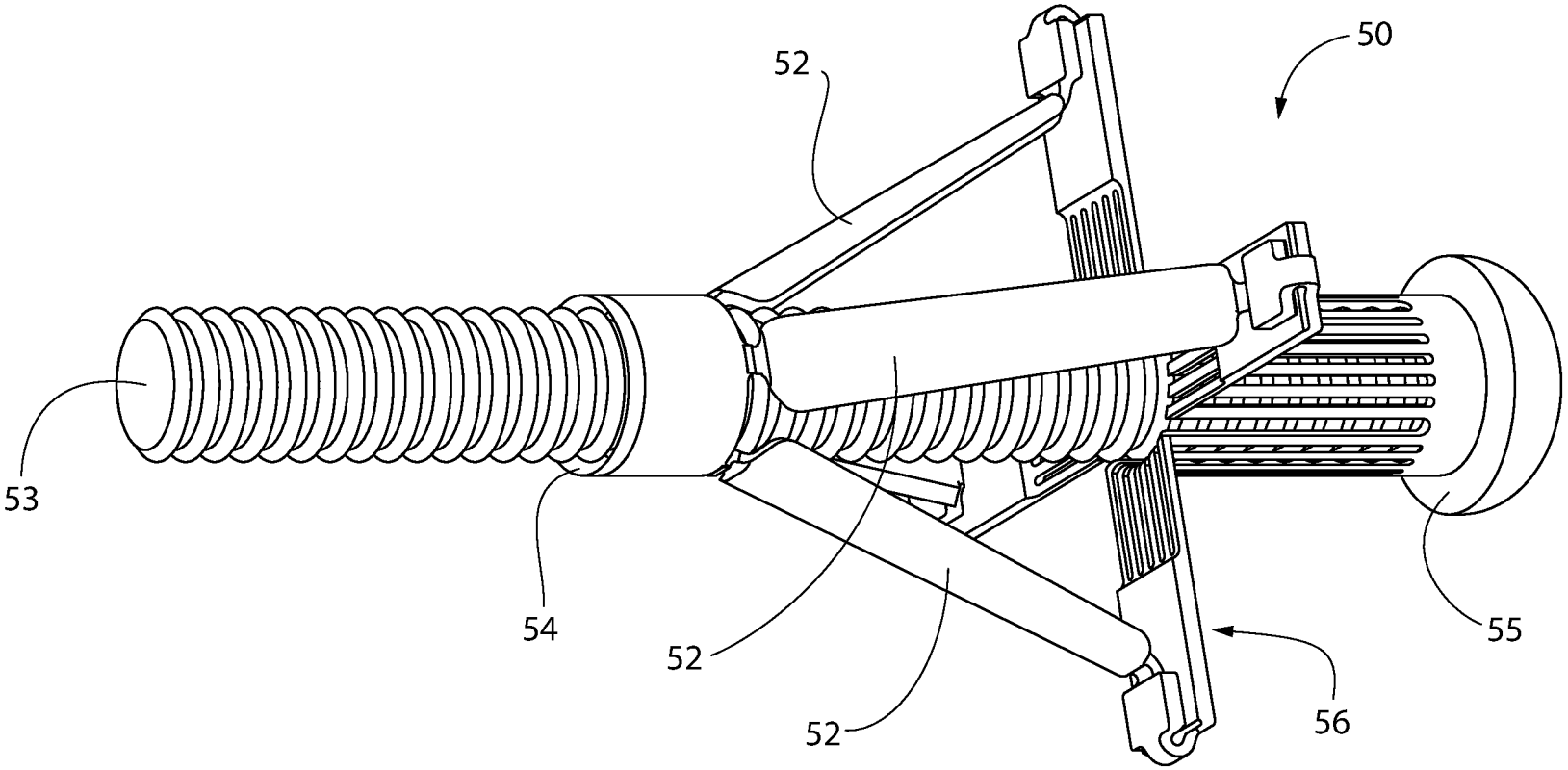
FIG. 5B is a perspective view of the wall fastener of FIG. 6A in an expanded state.

Referring to FIGS. 5A and 5B, the first and second wall fasteners 50, 150 will be further described in accordance with one exemplary and non-limiting embodiment of the present invention. FIGS. 5A and 5B will be described with reference to the first wall fastener 50, it being understood that the second wall fastener 150 is identical to the first wall fastener 50. Thus, while the description is provided with reference to the first wall fastener 50, it is entirely applicable to the second wall fastener 150. The first wall fastener 50 is an expandable fastener that may be used to secure the first mounting bracket 20 to the support structure 5, whereas the second wall fastener 150 is identical to the first wall fastener 50 and may be used to secure the second mounting bracket 120 to the support structure 5. The support structure 5 may be a hollow wall, such as drywall, plasterboard, or the like in some embodiments, although the support structure 5 is not limited to these structures in all embodiments as discussed above.

In the exemplified embodiment, the first wall fastener 50 comprises a sheath portion 51 and a central threaded bolt 53 which is positioned within an interior of the sheath portion 51. That is, the sheath portion 51 is positioned around the central threaded bolt 53 so as to surround the central threaded bolt 53. The sheath portion 51 comprises a plurality of bendable columns 52, a cup portion 54, and a head 55. The cup portion 54 may comprise threads on its inner surface that mate with the threads on the central threaded bolt 53 to couple the sheath portion 51 to the central threaded bolt 53 and to facilitate altering of the first wall fastener 50 between the unexpanded and expanded states shown in FIGS. 5A and 5B, respectively.

Due to the threaded coupling between the cup portion 54 and the central threaded bolt 53, rotating the central threaded bolt 53 relative to the sheath portion 51 will cause the cup portion 54 to move axially along the central threaded bolt 53 to allow altering of the first wall fastener 50 between the unexpanded and expanded states. Thus, from the unexpanded state shown in FIG. 5A, a user can rotate the central threaded bolt 53 clockwise relative to the sheath portion 51, which causes the cup portion 54 to move downwardly along the length of the central threaded bolt 53. Continued rotation of the central threaded bolt 53 causes the cup portion 54 to continue to move axially along the length of the central threaded bolt 53 until the first wall fastener 50 is in the fully expanded state as shown in FIG. 5B. In the expanded state, the sheath portion 51 comprises wings 56 that are oriented perpendicularly relative to the axis of the central threaded bolt 53. These wings 56 are able to engage a rear surface of a wall or other support structure (such as support structure 5 shown in FIG. 1) to prevent the first wall fastener 50 from being removed from the support structure 5 once installed and altered into the expanded state. This is shown in FIG. 1 with reference to the second wall fastener 150, and the components of the second wall fastener 150 are numbered identically to the first wall fastener 50 except that the 100 series of numbers are used. The first and second wall fasteners 50, 150 are identical in the exemplified embodiment. Additional details about the first and second wall fasteners 50, 150 may be found in U.S. Pat. No. 9,453,524, issued on Sep. 27, 2016, the entirety of which is incorporated herein by reference.

Referring to FIGS. 3, 5A, and 5B, while in the unexpanded state as shown in FIG. 5A, the first wall fastener 50 can be inserted into the first mounting aperture 26 of the first shelf engaging portion 22 through the first opening 27. The first wall fastener 50 can be moved axially within the first mounting aperture 26 until a portion of the first wall fastener 50 extends through the second opening 28 in the rear surface 24 of the first mounting bracket 20. Once fully inserted, the head 55 of the first wall fastener 50 remains within the first mounting aperture 26 of the first mounting bracket 20 because the head 55 of the first wall fastener 50 has a greater cross-sectional area than the second portion 207 of the first mounting aperture 26, which prevents the first wall fastener 50 from passing entirely through the first mounting aperture 26. Thus, a lower flange of the head 55 rests against the shoulder 203 of the first mounting bracket 20 and prevents the first wall fastener 50 from passing entirely through the first mounting aperture 26. This will be described in greater detail below with reference to FIG. 7.

Once the portion of the first wall fastener 50 passes through the second opening 28 in the rear surface 24 of the first mounting bracket 20 and into an opening in the support structure 5 (such as opening 6 shown in FIG. 2), the central threaded bolt 53 may be rotated clockwise. As described above, and with reference to FIG. 5B, such rotation of the first wall fastener 50 causes the cup portion 54 to move downwardly along the central threaded bolt 53 in the direction of the head 55. As mentioned above, the cup portion 54 may have threads that engage or mate with threads on the central threaded bolt 53 to facilitate the movement of the cup portion 54 during rotation of the central threaded bolt 53. This movement of the cup portion 54 causes the four bendable columns 52 to fold outwardly, forming the wings 56. The first wall fastener 50 can be rotated until the four bendable columns 52 reach the state shown in FIG. 5B, which is the fully expanded state of the first wall fastener 50. In such a state, ends of the bendable columns 52 which form the wings 56 will abut against the surface of the support structure 5 which is opposite to the exposed surface, to securely mount the first mounting bracket 20 to the support structure 5. FIG. 1 illustrates the second wall fastener 150 with its wings 56 abutted against the non-exposed surface 7 of the support structure 5.

The specific embodiment of the wall fastener 50 described with reference to FIGS. 5A and 5B is merely one exemplary embodiment of the wall fastener 50. In other embodiments, the wall fastener 50 may be a conventional screw, which may be used alone or in conjunction with a wall anchor to mount the first mounting bracket 20 (and the mounting bracket assembly 110) to the support structure 5. Other fasteners can also be used in other embodiments. For example, if the support structure 5 is a wall and it includes studs, a screw screwed into the studs or a nail hammered into the studs may provide sufficient support for the shelf assembly 1 and any items held thereon. The particular first and second wall fasteners 50, 150 described herein may be more applicable for a hollow support structure that does not have studs or when the shelf assembly 1 is being mounted at a location that does not include studs. However, it should be appreciated the first and second wall fasteners 50, 150 described herein are not needed for mounting the mounting bracket assembly 110 to the support structure 5 in all embodiments, and other more generic fasteners such as screws, bolts, nails, and the like could be used for this purpose in other embodiments.

Figure 6:
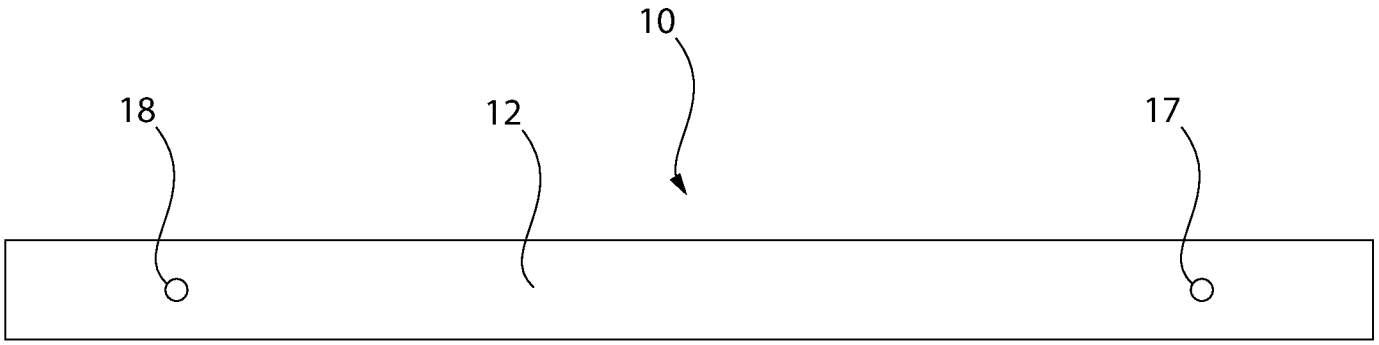
FIG. 6 is a rear view of a shelf of the shelf apparatus of FIG. 1.

Referring to FIGS. 1, 2, and 6, the shelf 10 will be described in more detail. The shelf 10 comprises the front edge 11, the rear edge 12, a first side edge 13, a second side edge 14, an upper surface or support surface 15, and a lower surface 16. The upper surface 15 is the surface of the shelf 10 that supports any items placed thereon. In general, it is desirable for the upper surface 15 of the shelf 10 to be oriented perpendicular to the support structure (i.e., wall) 5 so that any items placed thereon do not fall off of the shelf 10. The shelf 10 may be formed from wood in some embodiments. In other embodiments, the shelf 10 may be formed from other materials including metal, plastic, or the like. In the exemplified embodiment, a first blind hole 17 and a second blind hole 18 are formed into the rear surface 12 of the shelf in a spaced apart manner. The first and second blind holes 17, 18 extend a distance into the shelf 10, but do not extend all the way through to the front edge 11 of the shelf 10. Although two of the blind holes 17, 18 are utilized in this embodiment, it is noted that fewer or more fasteners can be used, and as a result, fewer or more blind holes can be provided. Further, although the two blind holes 17, 18 are equally spaced from the corresponding side edges 13, 14 of the shelf 10, the two blind holes 17, 18 may be positioned anywhere along the rear face 12 of the shelf 10 in other embodiments.

The first and second shelf fasteners 30, 130 comprise a first portion 31, 131 and a second portion 32, 132. The second portions 32, 132 of the first and second shelf fasteners 30, 130 are threaded in the exemplified embodiment and the first portions 31, 131 of the first and second shelf fasteners 30, 130 are not threaded in the exemplified embodiment. The first and second shelf fasteners 30, 130 are coupled to the shelf 10 so that the second portions 32, 132 of the first and second shelf fasteners 30, 130 are embedded within the shelf 10 and the first portions 31, 131 of the first and second shelf fasteners 30, 130 protrude from the rear edge 12 of the shelf 10. The threads on the second portions 32, 132 of the first and second shelf fasteners 30, 130 may facilitate the coupling of the first and second shelf fasteners 30, 130 to the shelf 10. The first shelf fastener 30 may be coupled to the shelf 10 within the first blind hole 17 and the second shelf fastener 130 may be coupled to the shelf 10 within the second blind hole 18. In some embodiments, the first and second shelf fasteners 30, 130 may create the first and second blind holes 17, 18 when being coupled to the shelf 10. In other embodiments, the first and second blind holes 17, 18 may be formed first (such as by drilling), and then the first and second shelf fasteners 30, 130 may be coupled to the shelf 10 within the first and second shelf fasteners 30, 130. In some embodiments, the first and second shelf fasteners 30, 130 may be attached to the shelf 10 by the manufacturer so that the shelf 10 is sold with the first and second shelf fasteners 30, 130 already attached.

The second portions 32, 132 of the first and second shelf fasteners 30, 130 need not be threaded in all embodiments. The threads facilitate the coupling of the first and second shelf fasteners 30, 130 to the shelf 10 in the exemplified embodiment, but other techniques can be used to achieve this coupling. For example, the second portions 32, 132 of the first and second shelf fasteners 30, 130 may have a diameter that ensures a very tight interference or friction fit between the first and second shelf fasteners 30, 130 and the shelf 10. In other embodiments, adhesives or welding can be used to couple the first and second shelf fasteners 30, 130 to the shelf 10. Thus, although in the exemplified embodiment the second portions 32, 132 of the first and second shelf fasteners 30, 130 are threaded for coupling to the shelf 10, the invention is not to be so limited and other techniques, structures, or the like may be used.

In the exemplified embodiment, the shelf 10 may be formed from wood and the first and second shelf fasteners 30, 130 may be formed from metal. However, the invention is not to be so limited. In other embodiments, the shelf 10 and the first and second shelf fasteners 30, 130 may all be formed from wood. In still other embodiments, the shelf 10 and the first and second shelf fasteners 30, 130 may all be formed from metal. In such an embodiment, the first and second shelf fasteners 30, 130 may be welded to the shelf 10. In some embodiments, an adhesive may be used to secure the first and second shelf fasteners 30, 130 to the shelf 10, and in such embodiments the second portions 32, 132 of the first and second shelf fasteners 30, 130 may not be threaded. The first and second shelf fasteners 30, 130 may alternatively be formed from plastic and secured to the shelf 10 using threads, adhesive, welding, or any other means.

Figure 7A:
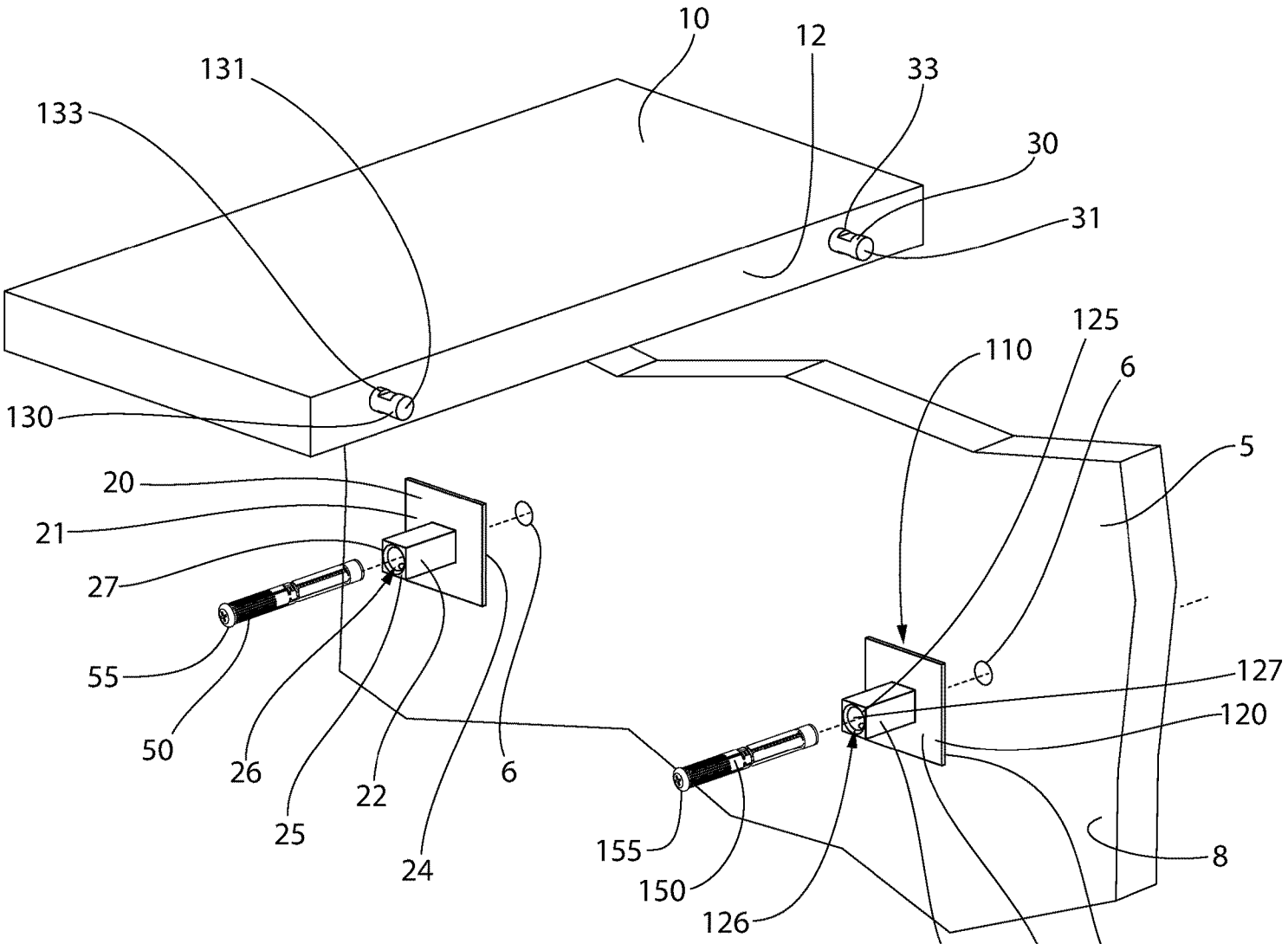
FIGS. 7A-7D sequentially illustrate the process of mounting the shelf system of FIG. 1 to a support structure such as a wall.
Figure 7B:
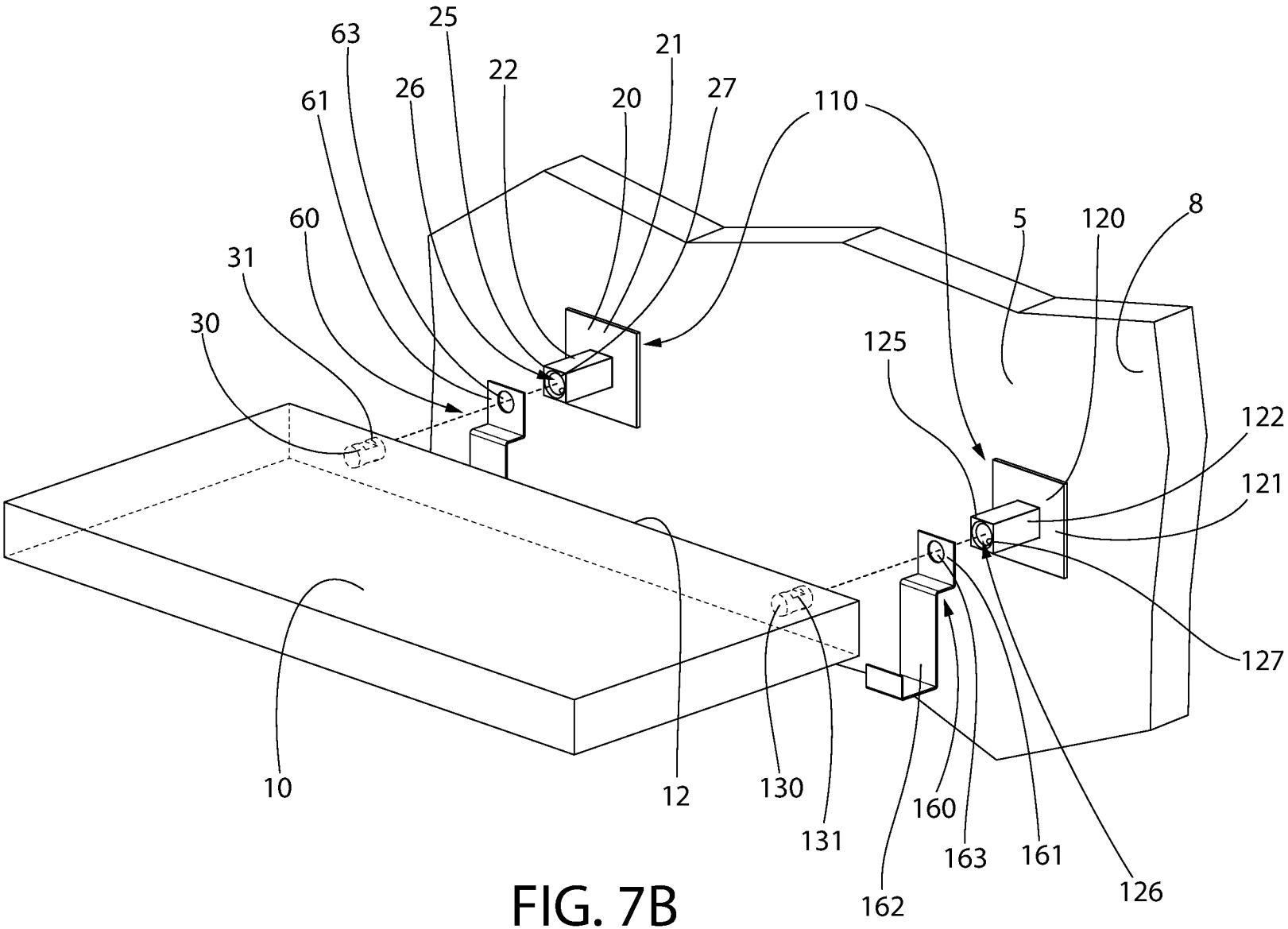
Figure 7C:
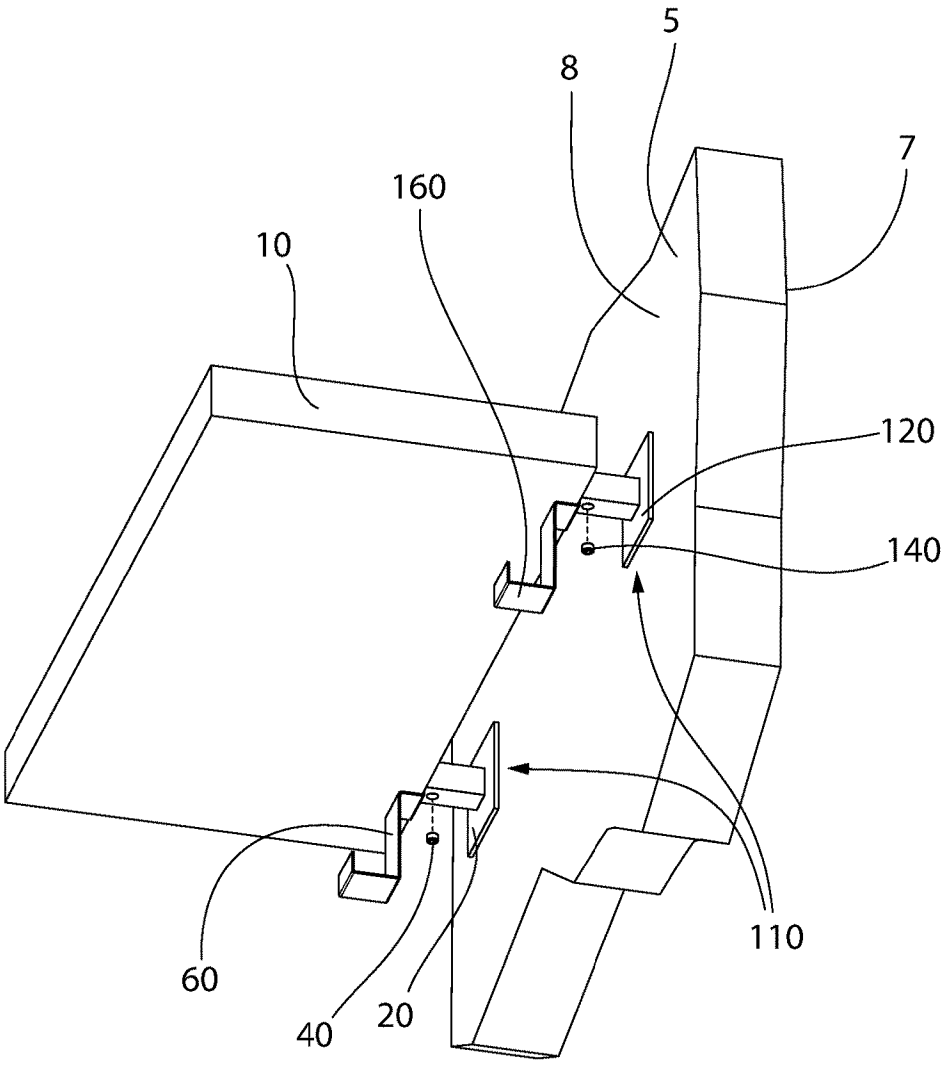
Figure 7D:
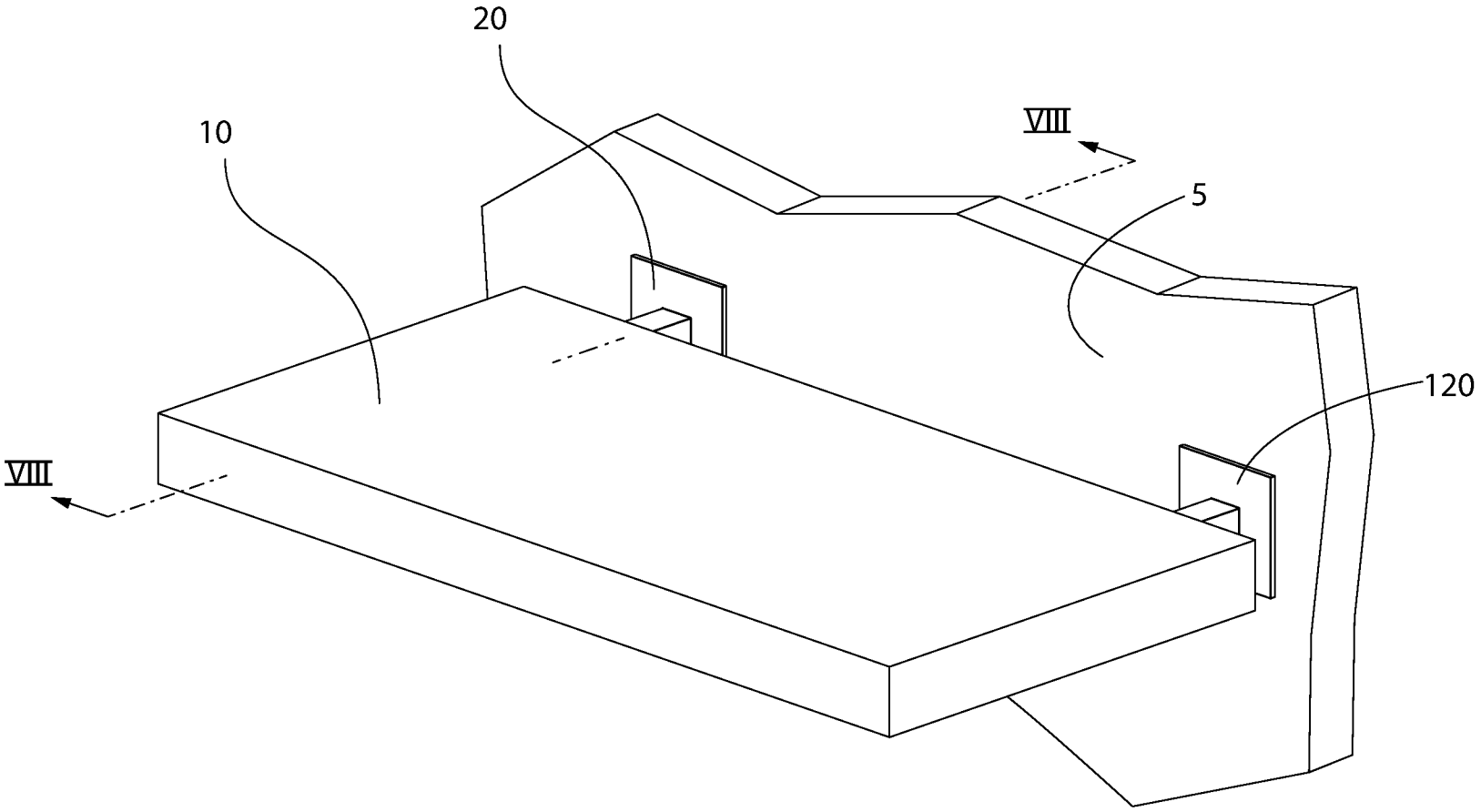
Figure 8:
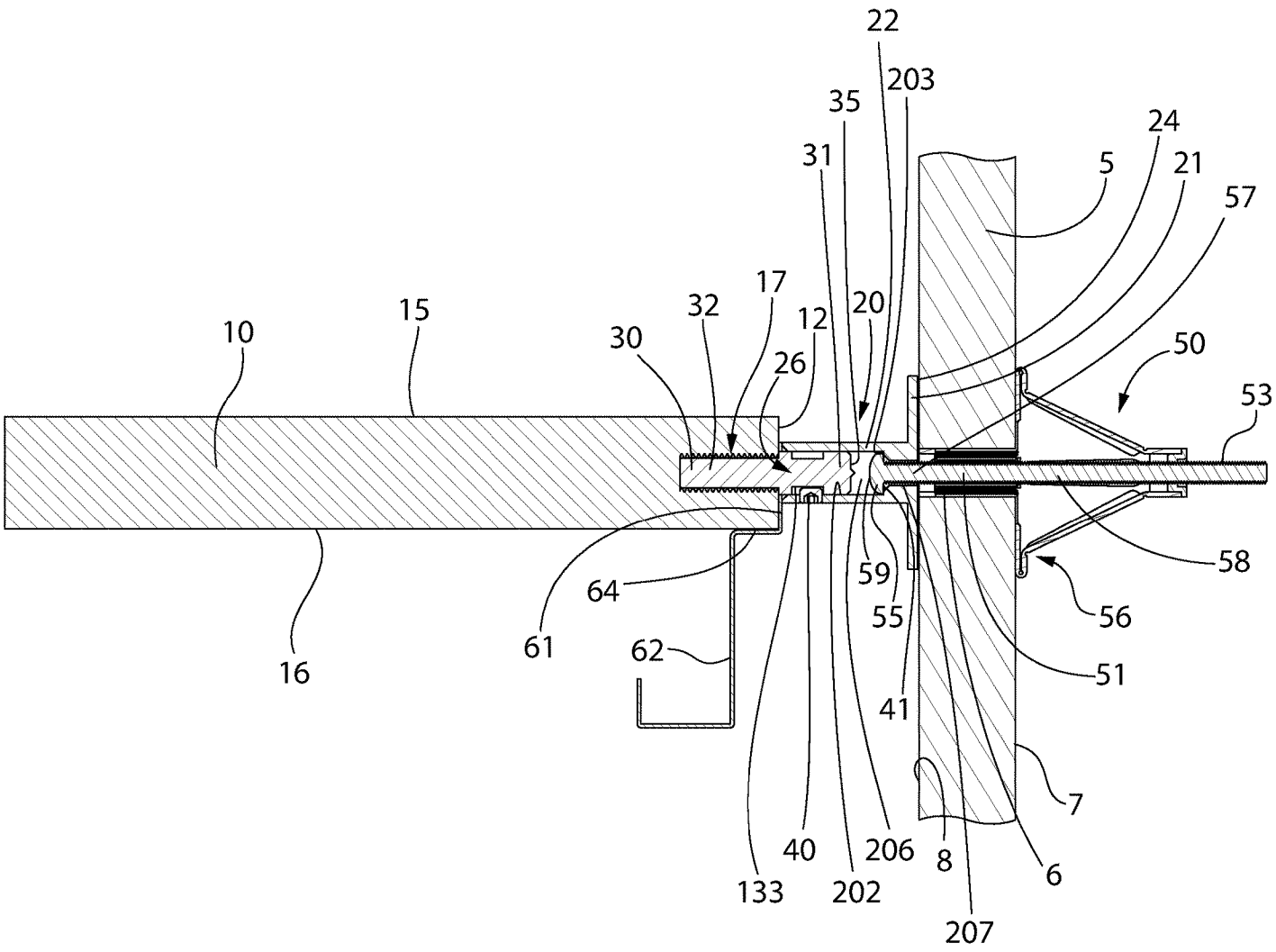
FIG. 8 is a cross-sectional view taken along line VIII-VIII of FIG. 7D.

Referring to FIGS. 7A-7D and 8, the process of mounting the shelf system 1 to the support structure 5 will be described. FIG. 8 illustrates the fully assembled and mounted shelf system 1 and should be viewed in conjunction with each of FIGS. 7A-7D for a full understanding of the invention and structural cooperation among the components. Referring first to FIG. 7A in conjunction with FIG. 8, the first and second mounting brackets 20, 120 of the mounting bracket assembly 110 are positioned adjacent to an exposed outer surface 8 of the support structure 5. In this embodiment, there are two holes pre-drilled into the support structure 5, identified as openings 6. The openings 6 can be pre-drilled with a drill in some embodiments. In other embodiments, there may not be pre-drilled openings 6. The first and second mounting brackets 20, 120 are positioned with their rear surfaces 24, 124 facing the exposed outer surface 8 of the support structure 5 and positioned so that the first and second mounting apertures 26, 126 are aligned with the pre-drilled holes 6 in the support structure 5.

The first and second mounting brackets 20, 120 are mounted to the support structure 5 as follows. The first wall fastener 50 (in the unexpanded state) is inserted into the first mounting aperture 26 through the first opening 27 in the distal end 25 of the shelf support portion 22 of the first bracket 20. The first wall fastener 50 is moved axially through the first mounting aperture 26 until the head 55, which forms an annular flange 41 that extends from the threaded portion of the first wall fastener 50, abuts against the shoulder 203 of the inner surface 202 of the shelf support portion 22 of the first bracket 20. The head 55 of the first wall fastener 50 cannot fit into the second portion 207 of the first mounting aperture 26 due to the diameter of the head 55 being greater than the diameter of the second portion 206 of the first mounting aperture 26. Thus, upon the head 55 abutting against the shoulder 203, the first wall fastener 50 cannot be moved axially any further in the direction of the support structure 5.

When the first wall fastener 50 is fully inserted into the first mounting aperture 26, the head 55 (i.e., a first portion of the first wall fastener) is positioned within the first portion 206 of the first mounting aperture 26 and the annular flange 41 formed by the head 55 abuts against the shoulder 203. Furthermore, a second portion 57 of the first wall fastener 50 is positioned within the second portion 207 of the first mounting aperture 26. Finally, a third portion 58 of the first wall fastener 50 protrudes from the rear surface 24 of the first bracket member 20. The second and third portions 57, 58 of the first wall fastener 50 comprise threaded portions of the central threaded bolt 53. As the first wall fastener 50 is moved axially through the first mounting aperture 26 of the first mounting bracket 20, the third portion 58 of the first wall fastener 50 extends into the opening 6 in the support structure 5. Once the first wall fastener 50 is in its final position, the first wall fastener 50 is rotated as described above with reference to FIGS. 5A and 5B to alter the first wall fastener 50 from its unexpanded state to its expanded state, which is what is shown in FIG. 8. In the expanded state, the wings abut against the non-exposed surface 7 of the support structure 5 and prevent the first wall fastener 50 from being removed from the support structure 5.

Although the description above is made with regard to the first wall fastener 50 which has an unexpanded and expanded state, as noted above the mounting of the first (and the second) mounting bracket 20 to the support structure 5 can be achieved with a conventional screw or other fastener in other embodiments. That is, a screw can be inserted into the first mounting aperture 26 so that the flange of the head of the screw abuts against the shoulder 203. The portion of the screw that protrudes from the rear surface 24 of the first mounting bracket 20 enters into the support structure 5 and is coupled thereto using traditional means, such as the screw being in direct contact with the support structure 5 or with the use of additional wall anchors.

The same process is then performed with the second wall fastener 150 and the second mounting bracket 120. Specifically, the second wall fastener 150 is inserted into the second mounting aperture 126 through the first opening 127 in the distal end 125 of the shelf support portion 122 of the second mounting bracket 120. The second wall fastener 150 is moved axially towards the support surface 5 until the head 155 of the second wall fastener 150 abuts the shoulder of the second mounting bracket 120. The second wall fastener 150 can then be altered from the unexpanded state to the expanded state if the second wall fastener 150 has the structure shown and described with reference to FIGS. 5A and 5B. Of course, as noted above, the first and second wall fasteners 50, 150 could be screws used alone or in conjunction with wall anchors, which would negate the need and ability to alter them between unexpanded and expanded states.

Upon the first and second wall fasteners 50, 150 being inserted into the first and second mounting apertures 26, 126 of the first and second bracket members 20, 120 of the mounting bracket assembly 110 and coupled to the support structure 5, the mounting bracket assembly 110 is mounted to the support surface 5. As shown in FIG. 7A, the first and second shelf fasteners 30, 130 are coupled to the shelf 10 so that the first portions 31, 131 of the first and second shelf fasteners 30, 130 protrude from the rear surface 12 of the shelf 10. The first portions 31, 131 of the first and second shelf fasteners 30, 130 may comprise one or more recesses 33, 133 (or an annular recess) which will cooperate with the set screws 40, 140 to lock the shelf 10 to the first and second mounting brackets 20, 120 and prevent disassembly until the set screws 40, 140 are disengaged from the first and second shelf fasteners 30, 130.

Next, the shelf 10 is mounted or coupled to the mounting bracket assembly 110. Referring to FIG. 7B in conjunction with FIG. 8, the rear surface 12 of the shelf 10 is positioned facing the support structure 5 and the distal ends 25, 125 of the shelf support portions 22, 122 of the first and second bracket members 20, 120. In the exemplified embodiment, the first and second hook members 60, 160 are also used and mounted to the support structure 5. Thus, in this embodiment, the first and second hook members 60, 160 are positioned in between the rear surface 12 of the shelf 10 and the distal ends 25, 125 of the first and second bracket members 20, 120. The first and second hook members 60, 160 each comprise a mounting portion 61, 161 and a hook portion 62, 162. The mounting portions 61, 161 are configured for mounting the hook members 60, 160 between the shelf 10 and the first and second mounting brackets 20, 120 and the hook portions 62, 162 hang beneath the shelf 10 so that articles can be hung therefrom. In the exemplified embodiment, the mounting portions 61, 161 of the first and second hook members 60, 160 each comprise a through-hole 63, 163. When assembled, the first portions 31, 131 of the first and second shelf fasteners 30, 130 extend through the through-holes 63, 163 of the mounting portions 61, 161 of the first and second hook members 60, 160, respectively. The first portions 31, 131 of the first and second shelf fasteners 30, 130 may be inserted through the through-holes 63, 163 of the hook members 60, 160 prior to coupling the shelf 10 to the first and second mounting brackets 20, 120. Alternatively, the first and second hook members 60, 160 may be placed against the distal ends 25, 125 of the first and second bracket members 20, 120 and then the first portions 31, 131 of the first and second shelf fasteners 30, 130 may be inserted through the through-holes 63, 163 as the first and second shelf fasteners 30, 130 are being inserted into the first and second mounting apertures 26, 126 of the first and second bracket members 20, 120. Moreover, as noted above, in still other embodiments the first and second hook members 60, 160 could be omitted.

Once the shelf 10 is positioned so that the first portions 31, 131 of the first and second shelf fasteners 30, 130 are aligned with the first and second mounting brackets 20, 120 as shown in FIG. 7B, the shelf 10 is moved towards the first and second mounting brackets 20, 120 and therefore towards the exposed surface 8 of the support structure 5. The shelf 10 is moved towards the first and second mounting brackets 20, 120 until the first portions 31, 131 of the first and second shelf fasteners 30, 130 extend through the first openings 27, 127 in the distal ends 25, 125 of the first and second shelf engaging portions 22, 122 of the first and second mounting brackets 20, 120. As noted, the first and second hook members 60, 160 may be positioned between the rear edge 12 of the shelf 10 and the distal ends 25, 125 of the first and second shelf engaging portions 22, 122 of the first and second mounting brackets 20, 120. In other embodiments, the first and second hook members 60, 160 may be omitted. In either case, the rear edge 12 of the shelf 10 is adjacent to the distal ends 25, 125 of the first and second shelf engaging portions 22, 122 of the first and second mounting brackets 20, 120. If the hook members 60, 160 are omitted, the rear edge 12 may be in direct contact with (i.e., abutting contact with) the distal ends 25, 125 of the first and second shelf engaging portions 22, 122 of the first and second mounting brackets 20, 120. If the first and second hook member 60, 160 are included as shown, the mounting portions 61, 161 of the first and second hook members 60, 160 are disposed between the rear edge 12 of the shelf 10 and the distal ends 25, 125 of the first and second mounting brackets 20, 120. In either case, the rear edge 12 of the shelf 10 is spaced from the support structure 5 by at least the length of the first and second mounting brackets 20, 120 (also by the thickness of the mounting portions 61, 161 of the first and second hook members 60, 160 when they are used as a part of the shelf system 1).

Referring to FIGS. 7C and 8, upon the first portions 31, 131 of the first and second shelf fasteners 30, 130 being fully inserted into the first and second mounting apertures 26, 126, the set screws 40, 140 may be tightened to lock the shelf 10 to the mounting bracket assembly 110. When the first portions 31, 131 of the first and second shelf fasteners 30, 130 are fully inserted within the first and second mounting apertures 26, 126 of the first and second shelf engaging portions 22, 122 of the mounting bracket assembly 110, at least one of the recesses 33, 133 of the shelf fastener 30 will be aligned with the locking aperture 208 of the first and second mounting brackets 20, 120. The set screws 40, 140 are then inserted through the locking aperture 208 such that the tips of the set screws 40, 140 nest within one of the recesses 33, 133 of the first and second shelf fasteners 30, 130 to frictionally engage the first and second shelf fasteners 30, 130 and prevent any subsequent movement. Once fully secured, a head of the set screws 40, 140 may be flush with the exterior surface of the sidewall 200 of the first and second shelf engaging portions 22, 122, as best shown in FIG. 8

In the exemplified embodiment, the second portions 32, 132 of the first and second shelf fasteners 30, 130 are threaded, but this is not required in all embodiments. In alternative embodiments the second portions 32, 132 of the first and second shelf fasteners 30, 130 could be a nail or any other fastener that is suitable for securing the shelf 10 to the mounting brackets 20. Further, although the first portions 31, 131 of the first and second shelf fasteners 30, 130 are unthreaded in the exemplified embodiment, this could be accomplished instead through the use of threads or any other suitable means for retaining an element within an aperture. Moreover, the recesses 33, 133 of the first and second shelf fasteners 30, 130 could be threaded or annular recesses to more securely engage the set screws 40, 140. In another embodiment, the set screws 40, 140 and recesses 33, 133 could be replaced with a hitch pin, slotted bolt, screw, or any other remove able fastener for preventing the movement of the first and second shelf fasteners 30, 130.

Thus, the first and second set screws 40, 140 may be tightened until a tip portion of the set screws 40, 140 enters into the recesses 33, 133 of the first portions 31, 131 of the first and second shelf fasteners 30, 130. The set screws 40, 140 do not provide any additional structural support for the shelf system 1, but merely prevent inadvertent disassembly of the shelf system 1. Specifically, in order to disassemble the shelf assembly 1, the set screws 40, 140 need to be loosened in order for the shelf 10 and the first and second shelf fasteners 30, 130 to be detached from the mounting bracket assembly 110.

FIG. 7D illustrates the shelf system 1 fully mounted on the support surface 5, although the hook members 60, 160 have been omitted in FIG. 7D. As noted above, the hook members 60, 160 are an optional addition to the shelf system 1 in some embodiments and are in not required for the shelf system 1 to be complete. This embodiment may be useful when installing multiple shelf systems 1 in a vertical array because the presence of the hook members 60, 160 would otherwise interfere with the shelf space for each of the shelf assemblies below.

As seen in FIG. 8, the first portion 31 of the shelf fastener 30 and the head 55 of the wall fastener 50 are both positioned within the first portion 206 of the first mounting aperture 26 of the first mounting bracket 20. However, the lengths of the shelf fastener 30 and the wall fastener 50 are such that a gap (i.e., an axial space) exists within the first mounting aperture 26 between a distal end 35 of the shelf fastener 30 and an end 59 of the wall fastener 50 that is defined by the head 55 of the wall fastener 50. This ensures that the shelf fasteners 30 do not abut against the wall fasteners 50 in such a way that might prevent the shelf 10 from being fully assembled onto the mounting bracket assembly 110. It should be noted that the cavity axis A-A is oriented perpendicular to the support structure 5 and parallel to the upper surface 15 of the shelf 10.

Moreover, although in the exemplified embodiment the first and second mounting brackets 20, 120 are secured to the support structure 5 by inserting the wall fasteners 50, 150 into the mounting apertures 26, 126 of the first and second mounting brackets 20, 120, the invention is not to be so limited in all embodiments. In an alternative embodiment, a plurality of apertures may be formed through the wall engaging portion 21, 121 of the first and second mounting brackets 20, 120, and screws can be inserted into the apertures in the wall engaging portions 21, 121 to couple the first and second mounting brackets 20, 120 to the support structure 5. However, the exemplified embodiment may be desirable due to its aesthetic appeal whereby no screws or fasteners are visible in the fully assembled shelf system 1 (other than the set screws 40, 140, but only when the shelf system 1 is viewed from below).

Furthermore, as seen in FIG. 8, the hook portion 62 of the first hook member 60 is offset from the rear edge 12 of the shelf 10 towards the front edge 11 of the shelf 10. This is due, in part, to the hook member 60 comprising a horizontal wall 64 extending between the mounting portion 61 and the hook portion 62 of the hook member 60. The horizontal wall 64 ensures that the hook portion 62 is positioned inward of the rear edge 12 of the shelf 10. The horizontal wall 64 could be omitted in alternative embodiments and the hook portion 62 could therefore be aligned with the rear edge 12 of the shelf 10.

In the exemplified embodiment, the first and second wall fasteners 50, 150 and the first and second shelf fasteners 30, 130 are both placed through the same opening in the distal ends 25, 125 of the first and second mounting brackets 20, 120. The set screws 40, 140 are then tightened to secure the first and second shelf fasteners 3, 130 to the first and second mounting brackets 20, 120. Although the assembly process describes a specific order, one skilled in the art would recognize that the order of these steps may be rearranged. In order to disassemble the shelf apparatus 1, a user would simply reverse the order above or its equivalent.

In the exemplified embodiment, the shelf 10 has a generally rectangular shape and extends perpendicular to the exposed outer surface 8 of the support structure 5 such that household items can rest on the upper surface 15 of the shelf 10. However, the shelf 10 is spaced from the support structure 5 such that its rear edge 12 does not abut directly against the support surface 5. Rather, there is a gap between the rear edge 12 of the shelf 10 and the support structure 5. Although the current embodiment of the shelf 10 has a rectangular shape, the shelf 10 may be square, triangular, circular, arcuate, or any other shape that can be configured to be mounted on the mounting bracket assembly 110. Moreover, the shelf 10 of the current embodiment is made of wood, however in other embodiments the shelf 10 may be made of plastic, composite, metal, or any other suitable material capable of supporting household items placed thereon.

Figure 9:
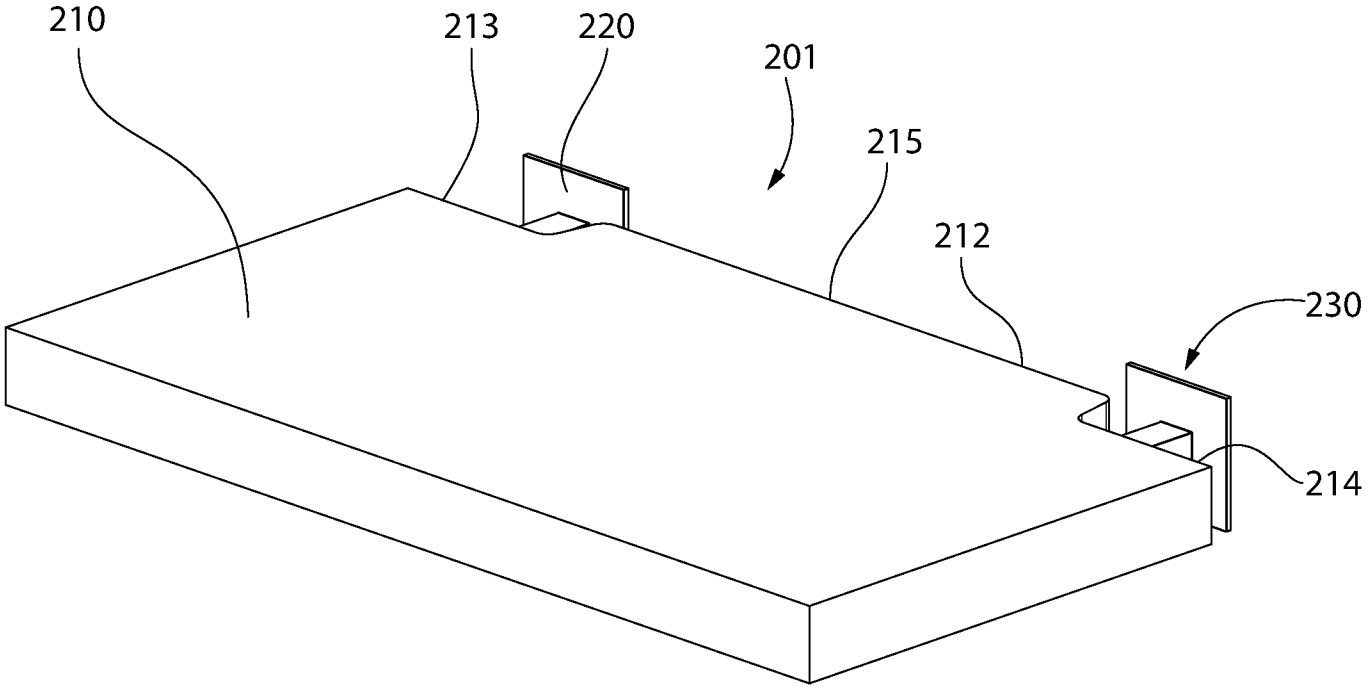
FIG. 9 is a perspective view of a shelf system in accordance with another embodiment of the present invention.

Referring now to FIG. 9, a shelf system 201 is illustrated in accordance with another embodiment of the present invention shows. The shelf system 201 generally comprises a shelf 210 and a mounting bracket assembly that comprises a first mounting bracket 220 and a second mounting bracket 230. The shelf system 201 also includes the shelf fasteners and the wall fasteners described above with reference to the shelf system 1, although those components are not visible in FIG. 9. Thus, the shelf system 201 is identical to the shelf system 1 described above, except with regard to the shape of the shelf 210. Specifically, the rear edge 212 of the shelf 210 includes a first recessed portion 213, a second recessed portion 214, and an extended portion 215 extending between the first and second recessed portions 213, 214. The first and second shelf fasteners (not shown) are coupled to the shelf 210 along the first and second recessed portions 213, 214 of the rear edge 212. Thus, when the shelf 210 is coupled to the first and second mounting brackets 220, 230 which are coupled to a support structure, the extended portion 215 of the shelf 210 may abut against or be immediately adjacent to the exposed outer surface of the support structure. Thus, the extended portion 215 of the rear edge 212 of the shelf 210 fills in the gap between the rear face 211 of the shelf 210 and the support structure. The extended portion 215 may thereby help to maximize the storage space of the shelf 210 without changing the overall footprint of the shelf 210. The descriptions of all other features of the shelf system 1 are applicable to the shelf system 201, other than the shape of the shelf 210 as noted herein.

Figure 10:
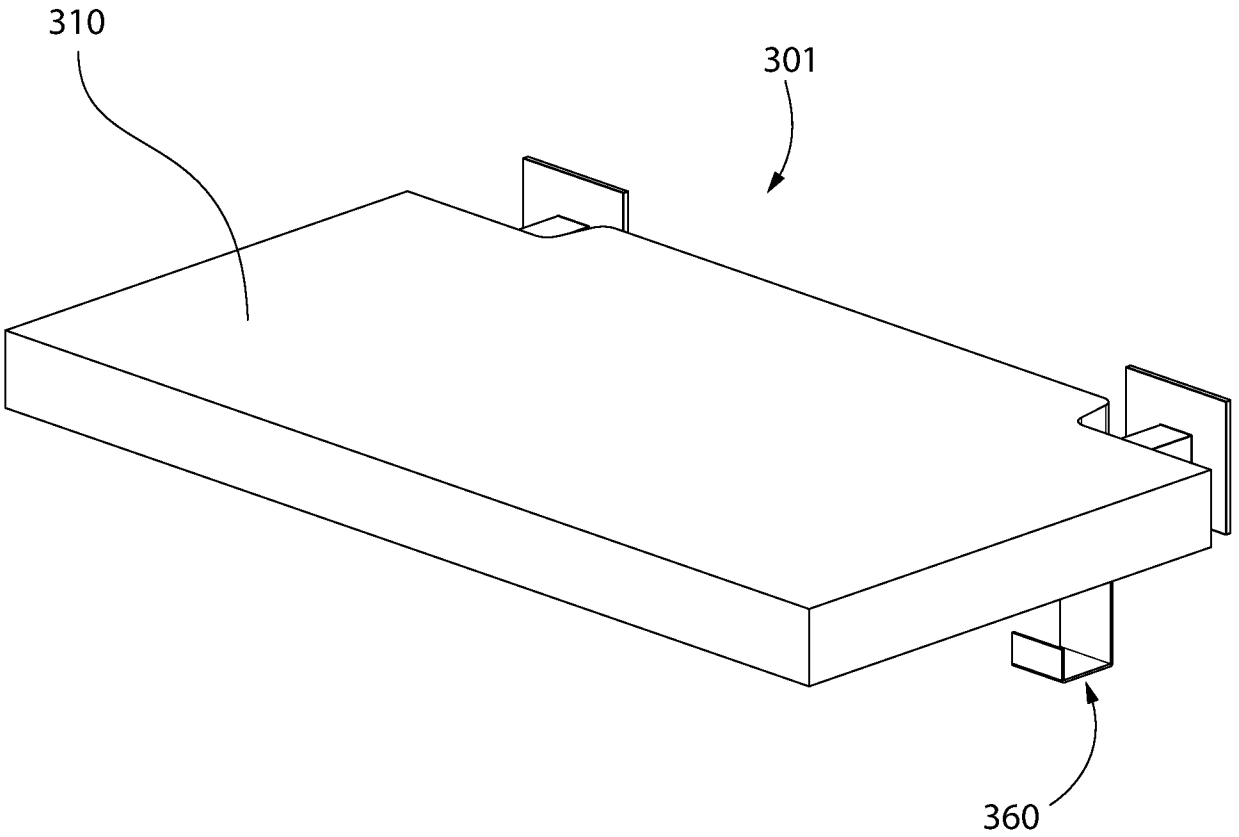
FIG. 10 is a perspective view of the shelf system of FIG. 9 with hook members included.

Referring now to FIG. 10, a shelf system 301 is illustrated which is identical to the shelf system 201, except it includes the addition of first and second hook members 360 (only one of which is visible in FIG. 10). This embodiment not only maximizes the shelf space available for the shelf system 301, but it also incorporates the hook members 360 for additional storage capabilities for items that may not easily rest on the shelf 310 or that would be better stored if hung.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

What is claimed is:

1. A shelf system comprising:

a shelf comprising a rear edge;

a first shelf fastener and a second shelf fastener coupled to the shelf, a first portion of each of the first and second shelf fasteners protruding from the rear edge of the shelf;

a mounting bracket assembly configured to be mounted to a wall, the mounting bracket assembly comprising:

a first shelf engaging portion configured to extend from the wall to a distal end and comprising an inner surface that defines a cavity that extends along a cavity axis that is perpendicular to the wall when the mounting bracket assembly is mounted to the wall; and a second shelf engaging portion configured to extend from the wall to a distal end and comprising an inner surface that defines a cavity that extends along a cavity axis that is perpendicular to the wall when the mounting bracket assembly is mounted to the wall;

wherein the first portions of the first and second shelf fasteners are positioned within the cavities of the first and second shelf engaging portions of the mounting bracket assembly, respectively, to couple the shelf to the mounting bracket assembly, at least a portion of the rear edge of the shelf being adjacent to the distal ends of the first and second shelf engaging portions of the mounting bracket assembly;

a first hook member comprising a mounting portion that is sandwiched between the rear edge of the shelf and the distal end of the first shelf engaging portion of the mounting bracket assembly and a hook portion positioned beneath a lower surface of the shelf and offset from the rear edge of the shelf in a direction towards a front edge of the shelf; and a second hook member comprising a mounting portion that is sandwiched between the rear edge of the shelf and the distal end of the second shelf engaging portion of the mounting bracket assembly and a hook portion positioned beneath the lower surface of the shelf and offset from the rear edge of the shelf in a direction towards the front edge of the shelf.

2. The shelf system according to claim 1 further comprising a first blind hole and a second blind hole formed into the rear edge of the shelf, and wherein a second portion of the first shelf fastener is disposed within the first blind hole of the shelf, to couple the first shelf fastener to the shelf and wherein a second portion of the second shelf fastener is disposed within the second blind hole of the shelf to couple the second shelf fastener to the shelf.

3. The shelf system according to claim 2 wherein the second portion of the first shelf fasteners and the second portion of the second shelf fastener are threaded to facilitate coupling the first and second shelf fasteners to the shelf, and wherein the first portions of the first and second shelf fasteners are not threaded.

4. The shelf system according to claim 1 further comprising:

a first locking aperture extending through the first shelf engaging portion of the mounting bracket assembly from an outer surface of the first shelf engaging portion to the inner surface of the first shelf engaging portion in a direction that is perpendicular to the cavity axis of the cavity of the first shelf engaging portion;

a first set screw positioned within the first locking aperture and configured to be tightened to engage the first portion of the first shelf fastener to prevent the first shelf fastener from being removed from the cavity of the first shelf engaging portion of the mounting bracket assembly;

a second locking aperture extending through the second shelf engaging portion of the mounting bracket assembly from an outer surface of the second shelf engaging portion to the inner surface of the second shelf engaging portion in a direction that is perpendicular to the cavity axis of the cavity of the second shelf engaging portion; and a second set screw positioned within the second locking aperture and configured to be tightened to engage the first portion of the second shelf fastener to prevent the second shelf fastener from being removed from the cavity of the second shelf engaging portion of the mounting bracket assembly.

5. The shelf system according to claim 4 wherein the first portion of the first shelf fastener comprises a recess, and wherein a tip portion of the first set screw nests within the recess of the first portion of the first shelf fastener when tightened to lock the first shelf fastener within the cavity of the first shelf engaging portion of the mounting bracket assembly, and wherein the first portion of the second shelf fastener comprises a recess, and wherein a tip portion of the second set screw nests within the recess of the first portion of the second shelf fastener to lock the second shelf fastener within the cavity of the second shelf engaging portion of the mounting bracket assembly.

6. The shelf system according to claim 1 further comprising:

a first mounting aperture extending from the distal end of the first shelf engaging portion to a rear surface of the mounting bracket assembly, the first mounting aperture comprising a first portion that forms the cavity of the first shelf engaging portion and has a first transverse cross-sectional area and a second portion having a second transverse cross-sectional area that is less than the first transverse cross-sectional area, the inner surface of the first shelf engaging portion comprising a shoulder that separates the first portion of the first mounting aperture from the second portion of the first mounting aperture, wherein the first portion of the first mounting aperture extends from the distal end of the first shelf engaging portion to the shoulder and the second portion of the first mounting aperture extends from the rear surface of the mounting bracket assembly to the shoulder; and a second mounting aperture extending from the distal end of the second shelf engaging portion to the rear surface of the mounting bracket assembly, the second mounting aperture comprising a first portion that forms the cavity of the second shelf engaging portion and has a first transverse cross-sectional area and a second portion having a second transverse cross-sectional area that is less than the first transverse cross-sectional area, the inner surface of the second shelf engaging portion comprising a shoulder that separates the first portion of the second mounting aperture from the second portion of the second mounting aperture, wherein the first portion of the second mounting aperture extends from the distal end of the second shelf engaging portion to the shoulder and the second portion of the second mounting aperture extends from the rear surface of the mounting bracket assembly to the shoulder.

7. The shelf system according to claim 6 further comprising:

a first wall fastener for coupling the mounting bracket assembly to the wall, the first wall fastener comprising a first portion located within the first portion of the first mounting aperture, a second portion located within the second portion of the first mounting aperture, and a third portion protruding from the rear surface of the mounting bracket assembly for insertion into the wall; and a second wall fastener for coupling the mounting bracket assembly to the wall, the second wall fastener comprising a first portion located within the first portion of the second mounting aperture, a second portion located within the second portion of the second mounting aperture, and a third portion protruding from the rear surface of the mounting bracket assembly for insertion into the wall.

8. The shelf system according to claim 7 wherein the first portion of the first wall fastener comprises an annular flange that protrudes radially from the second portion of the first wall fastener, the annular flange of the first portion of the first wall fastener abuts against the shoulder of the inner surface of the first shelf engaging portion and cannot fit within the second portion of the first mounting aperture, and wherein the first portion of the second wall fastener comprises an annular flange that protrudes radially from the second portion of the second wall fastener, the annular flange of the first portion of the second wall fastener abuts against the shoulder of the inner surface of the second shelf engaging portion and cannot fit within the second portion of the second mounting aperture.

9. The shelf system according to claim 7 wherein the first mounting aperture extends from a first opening in the distal end of the first shelf engaging portion to a second opening in the rear surface of the mounting bracket assembly and the second mounting aperture extends from a first opening in the distal end of the second shelf engaging portion to a third opening in the rear surface of the mounting bracket assembly, and wherein the first wall fastener is inserted into the first mounting aperture through the first opening in the distal end of the first shelf engaging portion and the second wall fastener is inserted into the second mounting aperture through the first opening in the distal end of the second shelf engaging portion to mount the mounting bracket assembly to the wall, and wherein after mounting the mounting bracket assembly to the wall, the first and second shelf fasteners are inserted through the first openings in the distal ends of the first and second shelf engaging portions, respectively, to mount the shelf to the mounting bracket assembly.

10. The shelf system according to claim 7 wherein an end of the first shelf fastener and an end of the first wall fastener that are positioned in the first mounting aperture are spaced apart in a direction of the cavity axis of the cavity of the first shelf engaging portion by a gap, and wherein an end of the second shelf fastener and an end of the second wall fastener that are positioned in the second mounting aperture are spaced apart in a direction of the cavity axis of the cavity of the second shelf engaging portion by a gap.

11. The shelf system according to claim 1 wherein the mounting bracket assembly comprises a first mounting bracket comprising a first wall engaging portion and the first shelf engaging portion and a second mounting bracket comprising a second wall engaging portion and the second shelf engaging portion, the first and second mounting bracket assemblies being separate and distinct from one another.

12. The shelf system according to claim 1 wherein the mounting portion of the first hook member comprises a through-hole through which the first shelf fastener extends, and wherein the mounting portion of the second hook member comprises a through-hole through which the second shelf fastener extends.

13. A shelf system comprising:

a shelf having a front edge, a rear edge, and a support surface extending from the front edge to the rear edge;

a first shelf fastener comprising a first portion and a second portion, the second portion being embedded within the shelf and the first portion protruding from the rear edge of the shelf;

a second shelf fastener comprising a first portion and a second portion, the second portion being embedded within the shelf and the first portion protruding from the rear edge of the shelf;

a first mounting bracket comprising a rear surface configured to abut an outer surface of a wall and a distal end, a first opening in the distal end, a second opening in the rear surface, and a first mounting aperture extending through the first mounting bracket along a first cavity axis from the first opening to the second opening, the first mounting aperture comprising a first portion located adjacent to the distal end and having a first transverse cross-sectional area and a second portion located adjacent to the rear surface and comprising a second transverse cross-sectional area that is less than the first transverse cross-sectional area;

a second mounting bracket comprising a rear surface configured to abut the outer surface of the wall and a distal end, a first opening in the distal end, a second opening in the rear surface, and a second mounting aperture extending through the second mounting bracket along a second cavity axis from the first opening to the second opening, the second mounting aperture comprising a first portion located adjacent to the distal end and having a first transverse cross-sectional area and a second portion located adjacent to the rear surface and comprising a second transverse cross-sectional area that is less than the first transverse cross-sectional area;

a first wall fastener inserted through the first opening in the distal end of the first mounting bracket to mount the first mounting bracket to the wall, a first portion of the first wall fastener located in the first portion of the first mounting aperture of the first mounting bracket, a second portion of the first wall fastener located in the second portion of the first mounting aperture of the first mounting bracket, and a third portion of the first wall fastener protruding from the rear surface of the first mounting bracket and configured for insertion into the wall;

a second wall fastener inserted through the first opening in the distal end of the second mounting bracket to mount the second mounting bracket to the wall, a first portion of the second wall fastener located in the first portion of the second mounting aperture of the second mounting bracket, a second portion of the second wall fastener located in the second portion of the second mounting aperture of the second mounting bracket, and a third portion of the second wall fastener protruding from the rear surface of the second mounting bracket and configured for insertion into the wall;

wherein the shelf is mounted to the first and second mounting brackets by inserting the first portion of the first shelf fastener into the first mounting aperture of the first mounting bracket through the first opening in the distal end of the first mounting bracket and inserting the first portion of the second shelf fastener into the second mounting aperture of the second mounting bracket through the first opening in the distal end of the second mounting bracket;

a first hook member comprising a mounting portion that is sandwiched between the rear edge of the shelf and the distal end of the first mounting bracket and a hook portion positioned beneath a lower surface of the shelf and offset from the rear edge of the shelf in a direction towards the front edge of the shelf; and a second hook member comprising a mounting portion that is sandwiched between the rear edge of the shelf and the distal end of the second mounting bracket and a hook portion positioned beneath the lower surface of the shelf and offset from the rear edge of the shelf in a direction towards the front edge of the shelf.

14. The shelf system according to claim 13 wherein the first shelf fastener and the first wall fastener are axially spaced apart within the first mounting aperture of the first mounting bracket and wherein the second shelf fastener and the second wall fastener are axially spaced apart within the second mounting aperture of the second mounting bracket.

15. The shelf system according to claim 13 further comprising:

a first locking aperture extending through the first mounting bracket in a direction that is perpendicular to the first cavity axis of the first mounting aperture of the first mounting bracket;

a second locking aperture extending through the second mounting bracket in a direction that is perpendicular to the second cavity axis of the second mounting aperture of the second mounting bracket;

a first set screw positioned within the first locking aperture and configured to be tightened to engage the first portion of the first shelf fastener; and a second set screw positioned within the second locking aperture and configured to be tightened to engage the first portion of the second shelf fastener.

16. The shelf system according to claim 13 wherein at least a portion of the rear edge of the shelf is adjacent to or in abutment with the distal ends of the first and second mounting brackets so that the portion of the rear edge of the shelf is spaced from the wall when the shelf is mounted to the wall.

17. The shelf system according to claim 13 wherein the rear edge of the shelf comprises a first recessed portion, a second recessed portion, and an extended portion extending between the first and second recessed portions, and wherein when the shelf is mounted to the wall the extended portion of the rear edge of the shelf is located closer to the wall than the first and second recessed portions of the rear edge of the shelf.

18. A method of mounting a shelf to a wall, the method comprising:

positioning a rear surface of a mounting bracket assembly against an outer surface of a wall, first and second shelf engaging portions of the mounting bracket assembly protruding from the outer surface of the wall;

inserting a first wall fastener through a first opening in a distal end of the first shelf engaging portion until a portion of the first wall fastener extends through a second opening in the rear surface of the mounting bracket assembly and into the wall;

inserting a second wall fastener through a first opening in a distal end of the second shelf engaging portion until a portion of the second wall fastener extends through a third opening in the rear surface of the mounting bracket assembly and into the wall;

inserting a first shelf fastener protruding from a rear edge of the shelf through an opening in a mounting portion of a first hook member, a hook portion of the first hook member being located beneath a lower surface of the shelf and offset from the rear edge of the shelf in a direction towards a front edge of the shelf;

inserting a second shelf fastener protruding from the rear edge of the shelf through an opening in a mounting portion of a second hook member, a hook portion of the second hook member being located beneath the lower surface of the shelf and offset from the rear edge of the shelf in the direction towards the front edge of the shelf;

aligning the first shelf fastener with the first opening in the distal end of the first shelf engaging portion of the mounting bracket assembly and aligning the second shelf fastener with the first opening in the distal end of the second shelf engaging portion of the mounting bracket assembly; and moving the shelf towards the wall so that:

the first shelf fastener extends through the first opening in the distal end of the first shelf engaging portion of the mounting bracket assembly and nests within a first cavity of the first shelf engaging portion of the mounting bracket assembly, the mounting portion of the first hook member being sandwiched between the rear edge of the shelf and the distal end of the first shelf engaging portion; and the second shelf fastener extends through the first opening in the distal end of the second shelf engaging portion of the mounting bracket assembly and nests within a second cavity of the second shelf engaging portion of the mounting bracket assembly, the mounting portion of the second hook member being sandwiched between the rear edge of the shelf and the distal end of the second shelf engaging portion.

* * * * *